US009931601B2

(12) United States Patent
Engelhard et al.

(10) Patent No.: US 9,931,601 B2
(45) Date of Patent: Apr. 3, 2018

(54) VENTURI BYPASS SYSTEM AND ASSOCIATED METHODS

(71) Applicant: Hayward Industries, Inc., Elizabeth, NJ (US)

(72) Inventors: Rolf Engelhard, Prescott, AZ (US); Joseph Anthony Tessitore, Winston-Salem, NC (US); Seth Darrell Renigar, Winston-Salem, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

(21) Appl. No.: 14/337,873

(22) Filed: Jul. 22, 2014

(65) Prior Publication Data

US 2016/0025117 A1 Jan. 28, 2016

(51) Int. Cl.

| | |
|---|---|
| ***F04F 5/04*** | (2006.01) |
| ***F04F 5/48*** | (2006.01) |
| ***F15D 1/02*** | (2006.01) |
| ***B01F 5/04*** | (2006.01) |
| ***B01F 3/04*** | (2006.01) |

(52) U.S. Cl.

CPC ..... *B01F 5/0423* (2013.01); *B01F 3/04503* (2013.01); *B01F 5/0426* (2013.01); *B01F 5/0428* (2013.01); *B01F 5/0498* (2013.01); *B01F 2003/04886* (2013.01)

(58) Field of Classification Search

CPC .... F04F 5/46; F04F 5/467; F15D 1/02; F15D 1/025; F15D 1/10

USPC ..... 137/599.11, 599.12, 599.13, 888, 890, 137/896; 417/163, 170, 185

See application file for complete search history.

(56) References Cited

U.S. PATENT DOCUMENTS

| | | | | | |
|---|---|---|---|---|---|
| 1,903 | A * | 12/1840 | Ravard | F04B 7/0053 | 417/149 |
| 148,111 | A * | 3/1874 | Cudlipp | F04F 5/46 | 417/151 |
| 398,456 | A * | 2/1889 | Secor | B63H 11/00 | 137/454.2 |
| 749,645 | A * | 1/1904 | Tuttle | G01F 5/00 | 137/599.12 |
| 1,105,581 | A * | 7/1914 | Rusby | G01F 5/00 | 137/494 |
| 1,511,048 | A * | 10/1924 | Cauthery | F04F 5/46 | 417/198 |
| 1,635,786 | A * | 7/1927 | Holmes | F04D 5/002 | 415/106 |
| 2,164,153 | A * | 6/1939 | Friedrich | B01F 5/0406 | 137/599.12 |

(Continued)

*Primary Examiner* — Seth W MacKay-Smith

(74) *Attorney, Agent, or Firm* — McCarter & English, LLP

(57) ABSTRACT

Exemplary embodiments are directed to venturi bypass systems that generally include a fluid inlet and a fluid outlet. The systems can include a venturi path disposed between the fluid inlet and the fluid outlet. The venturi path can include a venturi defining a venturi inlet and a venturi outlet. The systems can include a bypass loop connected to the venturi path at a joint upstream of the venturi outlet. The systems can include a separation tube connected to the venturi outlet. The separation tube can extend fluid flowing through the venturi path downstream of the joint at which the bypass loop connects to the venturi path. Exemplary embodiments are also directed to methods of regulating fluid flow through a venturi bypass system.

21 Claims, 12 Drawing Sheets

(56) References Cited

U.S. PATENT DOCUMENTS

| | | | | | |
|---|---|---|---|---|---|
| RE21,416 | E | * | 4/1940 | Sargent | F01N 5/00 261/DIG. 75 |
| 3,257,180 | A | * | 6/1966 | King | B01F 3/026 137/599.11 |
| 3,473,567 | A | * | 10/1969 | Kitchenmaster | E03C 1/021 137/888 |
| 3,547,409 | A | * | 12/1970 | Jacuzzi | B01F 5/0411 366/142 |
| 3,689,237 | A | * | 9/1972 | Stark et al. | B01F 5/0415 137/110 |
| 3,739,794 | A | * | 6/1973 | Lindgren | B01F 5/0451 137/1 |
| 4,462,429 | A | * | 7/1984 | Coursen | E21B 43/26 137/13 |
| 4,722,363 | A | * | 2/1988 | Allyn | G05D 11/006 137/13 |
| 5,099,881 | A | * | 3/1992 | Nakajima | G01F 5/00 137/599.13 |
| 5,105,843 | A | * | 4/1992 | Condron | B01F 5/0405 137/13 |
| 5,707,408 | A | * | 1/1998 | Kudo | C10L 3/00 48/117 |
| 5,762,416 | A | * | 6/1998 | LeSire | B01F 5/043 366/136 |
| 6,623,154 | B1 | * | 9/2003 | Garcia | B01F 5/0415 137/888 |

* cited by examiner

VENTURI BYPASS SYSTEM AND ASSOCIATED METHODS

TECHNICAL FIELD

The present disclosure relates to a venturi bypass system and associated methods and, in particular, to a venturi bypass system which provides a greater efficiency, including a reduced pressure drop between an inlet and an outlet to achieve a desired suction and/or an improved suction without increasing a pressure drop.

BACKGROUND

Venturi systems are generally used in a variety of industries to add or inject a gas or a liquid into an existing stream of liquid. Venturi systems are typically designed for a given motive flow and operate on a narrow range. For example, if a venturi system is designed for a motive flow of 10 gallons per minute (GPM), it may have an effective range between approximately 6 GPM and 14 GPM. Specifically, a motive flow below approximately 6 GPM may not initiate suction and a motive flow above approximately 14 GPM may create an excessively unacceptable pressure drop.

In situations where the motive flow may vary significantly, the venturi system may be implemented with a bypass module or system to address this. For example, if a given application has a flow rate of approximately 100 GPM and includes an injection of a gas or liquid, a user may choose a venturi system that is designed for an ideal motive flow of 10 GPM. In such a case, a bypass loop may be created to allow approximately 90 GPM to flow through the bypass module and approximately 10 GPM to flow through the venturi system.

A venturi bypass module or system may include two separate loops or paths, e.g., a venturi path and a bypass loop. In a situation which requires a total fluid flow of approximately 100 GPM, the venturi chosen may require 10 GPM, the bypass therefore being approximately 90 GPM to provide for the remaining fluid flow passing through the system.

A restriction in the bypass loop may be created in a variety of ways. Some bypass modules in the industry use either a manually adjusted bypass valve or an automatic bypass valve to achieve the proper motive flow through the venturi. For example, a manual valve incorporated into a bypass loop can be restricted to a point where the proper motive flow through the venturi can be achieved. As the overall fluid flow changes through the venturi system, the manual valve restriction can be provided with readjustment to maintain the ideal motive flow through the venturi. Automatic bypass valves may use a variety of methods to automatically restrict the bypass flow to such a degree that the ideal motive flow through the venturi can be maintained. For example, a spring-loaded valve can be used to create an automatic bypass valve. By choosing the proper spring tension, the bypass flow can be regulated to maintain the fluid flow through the venturi near or at the ideal motive flow.

In general, a traditional venturi bypass module or system can be created as a venturi-preference bypass module or a bypass-preference bypass module. With reference to FIG. 1, a diagram of a traditional venturi-preference bypass module 10 is provided. In the bypass module 10, fluid, such as water, can flow through a venturi 12 in a substantially straight line between a fluid inlet 14 and a fluid outlet 16 that is in-line with the fluid inlet 14. The venturi 12 can include a suction port 18 leading into the venturi 12. The bypass loop 20 can be defined by a number of turns, e.g., offset passages relative to the in-line (e.g., straight) passage between the fluid inlet 14 and the fluid outlet 16. For example, the bypass loop 20 can separate at a joint 24, e.g., a T-joint, from the total fluid flow entering through the fluid inlet 14. The bypass loop 20 can include a bypass valve 22 before the bypass loop 20 rejoins the total fluid flow at a joint 26, e.g., a T-joint, prior to the fluid outlet 16. The bypass valve 22 can be regulated to vary a restriction of fluid flow through the bypass loop 20.

The bypass module 10 configuration of FIG. 1 can provide a clean flow path for the venturi 12 with a high fluid inlet 14 pressure and a low fluid outlet 16 pressure to create a maximum suction into the venturi 12 through the suction port 18. In addition, the incoming fluid flowing through the venturi 12 in a straight line, in combination with the forced fluid turn into the bypass loop 20, can create a desirable "ram pressure" on the venturi 12 inlet. The bypass loop 20 may need a restriction therein such that, for example, approximately 10 GPM can flow through the venturi 12. For example, if the bypass loop 20 was a clean, straight piece of pipe, the fluid flowing through the bypass module 10 may take the path of least resistance, thereby not necessarily being focused through the venturi 12. By having the fluid flow through a number of T-joints and elbow fittings, e.g., joints 24, 26, in the bypass loop 20, a restriction of the bypass loop 20 can be created. The created restriction of the bypass loop 20 generally provides less of a pressure drop through the bypass valve 22 than the pressure drop of the bypass-preference bypass module 50 described below with respect to FIG. 2.

With reference to FIG. 2, a diagram of a traditional bypass-preference bypass module 50 is provided. In the bypass module 50, fluid can flow in-line through the bypass path 52, including a bypass valve 54, in a substantially straight line between a fluid inlet 56 and a fluid outlet 58. The fluid flow into and through a venturi 60 can take a number of turns before rejoining the total fluid flow. For example, the venturi 60 can separate at a joint 62, e.g., a T-joint, from the total fluid flow entering through the fluid inlet 56, pass through the venturi 60 and connect to the total fluid flow at a joint 64, e.g., a T-joint, before the fluid outlet 58. The venturi 60 can include a suction port 66 leading into the venturi 60.

The bypass module 50 configuration of FIG. 2 generally creates a cleaner flow path through the bypass path 52 than the venturi 60. However, this may defeat a purpose of the bypass path 52 (to create a restriction in the bypass module 50). A greater pressure drop through the bypass valve 54 can typically be used to compensate for the cleaner flow path through the bypass path 52.

The bypass module 10 configuration of FIG. 1. may be considered to be more efficient than the bypass module 50 configuration of FIG. 2 due to a smaller pressure drop and a greater suction at the venturi 12. However, both bypass modules 10 and 50 still incur high pressure drops at points where fluid flowing from the venturi 12 and 60 mixes with fluid discharged from the bypass loop 20 in a turbulent manner due to the perpendicular orientation of the fluids. This high pressure drop can require additional pump horsepower to maintain the desired fluid flow through the venturi 12 and 60. The additional pump horsepower can translate into additional or higher energy usage for the bypass modules 10 and 50.

Thus, a need exists for a venturi bypass system which provides greater efficiency, including a reduced pressure drop between an inlet and an outlet to achieve a required suction and/or an improved suction without increasing a pressure drop. These and other needs are addressed by the venturi bypass systems and associated methods of the present disclosure.

SUMMARY

In accordance with embodiments of the present disclosure, exemplary venturi bypass systems are provided that generally include a fluid inlet and a fluid outlet. The systems include a venturi path disposed between the fluid inlet and the fluid outlet. The venturi path can include a venturi defining a venturi inlet and a venturi outlet. The systems include a bypass loop connected to the venturi path at a joint upstream of the venturi fluid outlet. The systems include a separation tube connected to the venturi outlet. The separation tube can extend fluid flowing through the venturi path downstream of the joint at which the bypass loop connects to the venturi path.

In some embodiments, the venturi path can be disposed in-line with the fluid inlet and the fluid outlet. The separation tube can prevent mixture of fluid flowing through the venturi path with fluid flowing through the bypass loop until a point downstream of the joint, e.g., an area of high pressure. In some embodiments, the separation tube can be concentrically positioned relative to the joint and the fluid outlet.

In some embodiments, the systems include a velocity ring disposed between the joint and the fluid outlet. The velocity ring can define a velocity ring inlet, a velocity ring outlet, and a restricted midpoint disposed between the velocity ring inlet and the velocity ring outlet. The restricted midpoint diameter can be dimensioned smaller than the velocity ring inlet diameter and the velocity ring outlet diameter. In some embodiments, the velocity ring includes a first tapered section connecting the velocity ring inlet to the restricted midpoint. In some embodiments, the velocity ring includes a second tapered section connecting the restricted midpoint to the velocity ring outlet.

In some embodiments, a distal end of the separation tube can concentrically extend into the restricted midpoint of the velocity ring. The restricted midpoint of the velocity ring can define an area of substantially developed flow and low pressure. Fluid discharged from the separation tube can mix with fluid discharged from the bypass loop at the restricted midpoint of the velocity ring to reduce a pressure drop between the fluid inlet and the fluid outlet. An area between an outer surface of the separation tube and an inner surface of the restricted midpoint can define a net area of fluid flow. In some embodiments, variation of the net area by variation of at least one of a diameter of the outer surface of the separation tube and a diameter of the inner surface of the restricted midpoint can vary an amount of pressure through the venturi bypass system. In some embodiments, variation of the net area by variation of at least one of the diameters of the outer surface of the separation tube and a diameter of the inner surface of the restricted midpoint can vary an amount of gas draw through a suction port of the venturi.

In some embodiments, the systems include a flow regulator concentrically disposed upstream of the venturi inlet for regulating fluid flow through the venturi path. In some embodiments, the flow regulator can define a tapered funnel configuration.

In some embodiments, the separation tube of the systems includes a broadening region at a distal end of the separation tube. The broadening region can define a broadening region inlet and a restricted outlet connected by a tapered section. An area between an inner surface of the fluid outlet and the restricted outlet of the broadening region of the separation tube can define a net area of fluid flow. In some embodiments, variation of the net area by variation of at least one of a diameter of the restricted outlet and a diameter of the inner surface of the fluid outlet can vary an amount of gas draw through the suction port of the venturi.

In accordance with embodiments of the present disclosure, exemplary methods of regulating fluid flow of a venturi bypass system are provided that generally include providing the venturi bypass system that includes a fluid inlet and a fluid outlet. The venturi bypass system includes a venturi path disposed between the fluid inlet and the fluid outlet. The venturi path can include a venturi defining a venturi inlet and a venturi outlet. The venturi bypass system can include a bypass loop connected to the venturi path at a joint upstream of the venturi fluid outlet. The venturi bypass system can further include a separation tube. The methods include connecting the separation tube to the venturi outlet. The methods include extending the separation tube downstream of the joint at which the bypass loop connects to the venturi path. The methods further include flowing fluid through the separation tube downstream of the joint at which the bypass loop connects to the venturi path, e.g., a high pressure area.

In some embodiments, the methods can include preventing mixture of fluid flowing through the venturi path with fluid flowing through the bypass loop until a point downstream of the joint. In some embodiments, the methods can include providing a velocity ring disposed between the joint and the fluid outlet. The velocity ring can define a velocity ring inlet, a velocity ring outlet, and a restricted midpoint disposed between the velocity ring inlet and the velocity ring outlet. In some embodiments, the methods can include concentrically extending the separation tube into the restricted midpoint of the velocity ring. In some embodiments, the methods can include reducing a pressure drop between the fluid inlet and the fluid outlet by mixing fluid discharged from the separation tube with fluid discharged from the bypass loop at the restricted midpoint of the velocity ring. In some embodiments, the methods can include regulating fluid flow through the venturi path by providing a concentrically disposed flow regulator upstream of the venturi inlet.

In some embodiments, the methods can include providing a broadening region at the distal end of the separation tube. The broadening region can define a broadening region inlet and a restricted outlet. In some embodiments, the methods can include reducing a pressure drop between the fluid inlet and the fluid outlet by passing fluid discharged from the bypass loop around the restricted outlet of the broadening region of the separation tube prior to mixing with the fluid discharged from the separation tube.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed venturi bypass systems and associated methods, reference is made to the accompanying figures, wherein.

DESCRIPTION OF EXEMPLARY EMBODIMENTS

Figure 1:
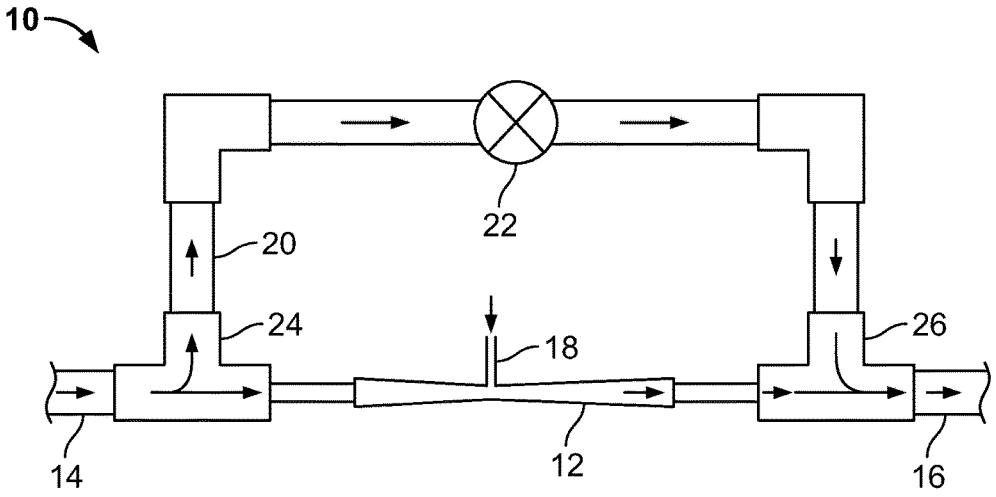
FIG. 1 (Prior Art)
FIG. 1 is a diagram of a traditional venturi-preference bypass system.
Figure 2:
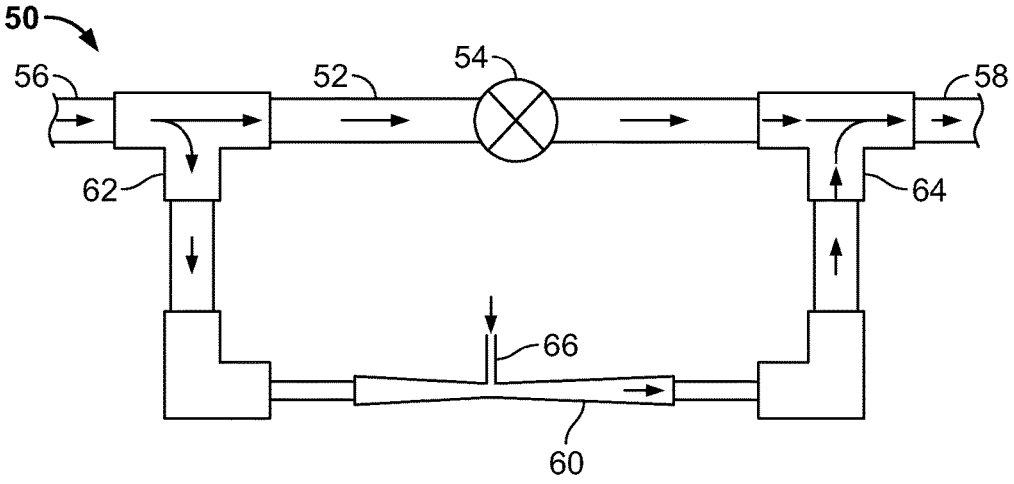
FIG. 2 (Prior Art)
FIG. 2 is a diagram of a traditional bypass-preference bypass system.
Figure 3:
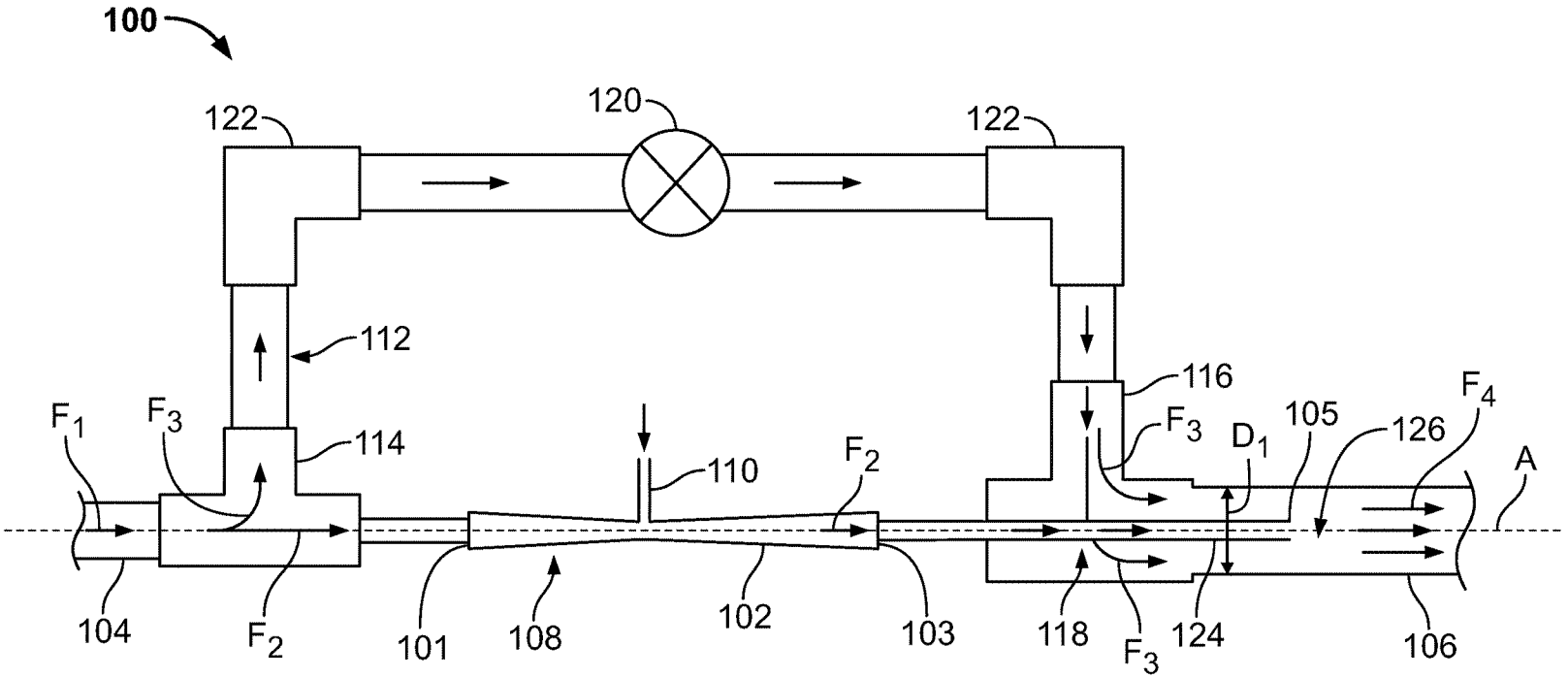
FIG. 3 is a side, partial cross-sectional diagram of a first embodiment of an exemplary venturi bypass system including a first embodiment of an exemplary separation tube according to the present disclosure.
Figure 4:
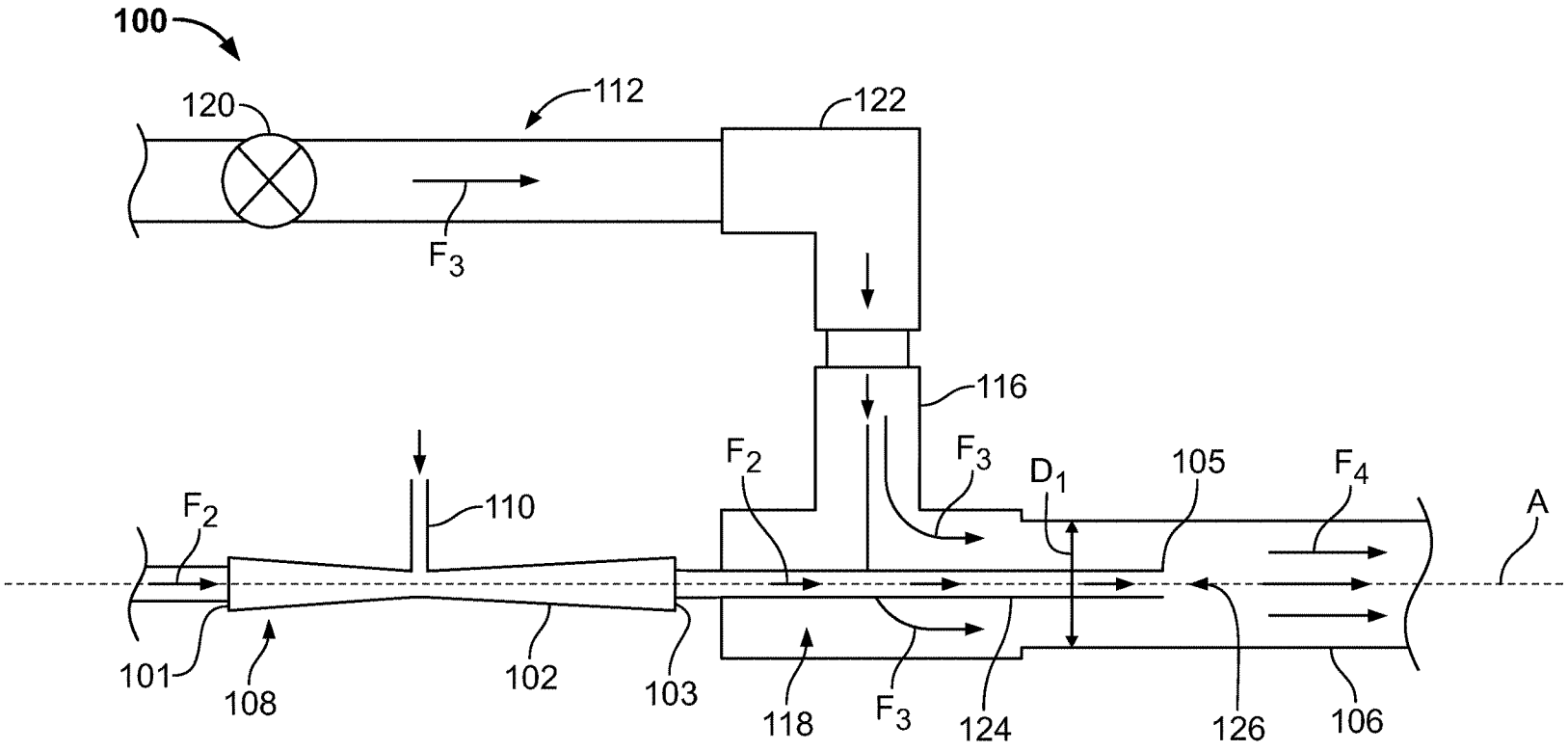
FIG. 4 is a side, partial cross-sectional detailed diagram of a first embodiment of an exemplary venturi bypass system including a first embodiment of an exemplary separation tube of FIG. 3.

Turning to FIGS. 3 and 4, side and detailed, partial cross-sectional schematic diagrams of a first embodiment of an exemplary venturi bypass module or system 100 (hereinafter "system 100") are provided. The system 100 generally includes a venturi 102 in-line (e.g., aligned in a substantially straight line) with a fluid inlet 104 and a fluid outlet 106 along a central axis A. The aligned flow between the fluid inlet 104 and the fluid outlet 106 through the venturi 102 can define the venturi path 108. The venturi 102 can include a venturi inlet 101 and a venturi outlet 103. It should be understood that in the schematic of FIGS. 3 and 4, fluid flow through the venturi path 108 enters through the venturi inlet 101 and exits out of the venturi outlet 103. Therefore, the venturi inlet 101 can be described as upstream of the venturi outlet 103 and the venturi outlet 103 can be described as downstream of the venturi inlet 101. In some embodiments, the venturi 102 can include a suction port 110 leading into the venturi 102.

The system 100 further includes a bypass loop 112 which separates from a total fluid flow at a joint 114, e.g., a T-joint, between the fluid inlet 104 and the venturi path 108. Although illustrated as a joint 114 defining a substantially ninety degree angle, in some embodiments, rounded joints and/or different angles of separation can be utilized. It should be understood that at the joint 114, a portion of the fluid flowing into the system 100 at the fluid inlet 104 can pass into the venturi path 108, while a portion of the fluid can be forced to turn into the bypass loop 112. In particular, the fluid $F_1$ at the fluid inlet 104 can represent the point of total fluid flow prior to reaching the joint 114. At the joint 114, the total fluid flow can separate into the fluid $F_2$ which passes into the venturi path 108 and the fluid $F_3$ which passes into the bypass loop 112. The venturi inlet 101 diameter can be dimensioned smaller than the fluid inlet 104 diameter such that only a portion of the fluid $F_1$ can pass through the venturi path 108. Therefore, upon reaching the joint 114, the restricted flow of fluid $F_2$ into the venturi inlet 101 can force the remaining fluid $F_3$ to pass through the bypass loop 112.

The bypass loop 112 can be defined by a number of turns relative to the venturi path 108 and can rejoin the total fluid flow downstream of a joint 116, e.g., a T-joint, between the venturi path 108 and the fluid outlet 106. In particular, fluid $F_3$ flowing through the bypass loop 112 can initially enter a high pressure area 118 due to the entrance of fluid $F_3$ from the bypass loop 112 in a substantially perpendicular orientation relative to the central axis A of the venturi path 108. The fluid $F_3$ can further pass downstream from the high pressure area 118 in the direction of the fluid outlet 106. Thus, the turbulent flow of the fluid $F_3$ in the high pressure area 118 can stabilize into a substantially developed flow between the high pressure area 118 and the fluid outlet 106. As referenced herein, developed flow can refer to flow which has substantially stabilized. Optionally, the bypass loop 112 can include a bypass valve 120 located between the upstream joint 114 and the downstream joint 116 for regulating the fluid $F_3$ flow through the bypass loop 112. In some embodiments, the bypass loop 112 can include one or more elbow connections 122 which create turns in the bypass loop 112 path. The turns in the bypass loop 112 and/or regulation of the bypass valve 120 can create a restriction of the fluid flow through the system 100.

In some embodiments, the exemplary system 100 can include a first embodiment of a venturi separation tube 124 which extends the flow of fluid $F_2$ exiting the venturi 102 from the venturi outlet 103. In particular, without the separation tube 124, fluid $F_2$ flow exiting the venturi 102 includes a mixture of both liquid and gas, e.g., ozone, which automatically mixes with the fluid $F_3$ flow discharged from the bypass loop 112 in the high pressure area 118 within the joint 116. The mixture of the venturi 102 fluid $F_2$ and the bypass loop 112 fluid $F_3$ in the high pressure area 118 generally reduces the desired pressure differential between the venturi inlet 101 and the venturi outlet 103 across the venturi 102 due to the difference in pressure at the fluid inlet 114 and the high pressure area 118. The venturi 102 efficiency, e.g., the ability of the venturi 102 to create suction on the suction port 110, can generally be proportional to the pressure differential between the venturi inlet 101 and the venturi outlet 103. Thus, to maintain the desired pressure differential through the venturi path 108 for a maximum efficiency of the venturi 102, the reduced pressure differential of traditional bypass modules requires greater pump and/or bypass valve 120 actuation, resulting in excessive and inefficient power consumption.

In contrast, the venturi separation tube 124 of the system 100 can carry the venturi 102 fluid $F_2$ flow downstream of the high pressure area 118 and into an area of substantially developed fluid flow 126 between the joint 116 and the fluid outlet 106. In particular, the separation tube 124 can separate the flow of the fluid $F_2$ from the fluid $F_3$ until substantially developed fluid flow has been achieved for both fluids $F_2$ and $F_3$. The separation tube 124 can extend from the venturi outlet 103, through the joint 116 and further extend at least partially into the fluid outlet 106. In particular, the separation tube 124 can concentrically extend through the joint 116 and concentrically extend at least partially in the direction of the fluid outlet 106 to the area of developed fluid flow 126. The separation tube 124 can therefore define an inner tube concentrically positioned within an outer tube, e.g., the joint 116 and the tube leading to the fluid outlet 106.

Thus, rather than mixing with the fluid $F_3$ discharged from the bypass loop 112 in the turbulent high pressure area 118, the fluid $F_3$ discharged from the bypass loop 112 into the joint 116 can remain separated from the fluid $F_2$ discharged from the venturi outlet 103 by the separation tube 124 until the fluid $F_3$ reaches a distal end 105 of the separation tube 124 located downstream of the joint 116. In particular, the fluid $F_2$ discharged from the venturi outlet 103 can flow in-line with the venturi 102 and in a substantially developed flow through the length of the separation tube 124 defined by the distance from the venturi outlet 103 to the distal end 105 of the separation tube 124 without mixing with the fluid $F_3$ from the bypass loop 112. The separation tube 124 thereby allows the fluid $F_2$ discharged from the venturi 102 to bypass the high pressure area 118 within the joint 116.

In contrast, the fluid $F_3$ discharged from the bypass loop 112 into the joint 116 can initially flow in a turbulent manner in the high pressure area 118 of the joint 116 without mixing with the fluid $F_2$ from the venturi 102. As the fluid $F_3$ flows downstream of the high pressure area 118, the fluid $F_3$ can progressively stabilize and define a substantially developed flow before reaching the distal end 105 of the separation tube 124. Thus, at the distal end 105 of the separation tube 124 and prior to mixing relative to each other, the flow of both the fluid $F_2$ discharged from the venturi 102 and the fluid $F_3$ discharged from the bypass loop 112 can be substantially developed.

Upon reaching the distal end 105 of the separation tube 124, the fluid $F_2$ can flow out of the separation tube 124 and mix with the fluid $F_3$ in a substantially developed manner in the area of developed fluid flow 126. The fluid outlet 106 diameter $D_1$ can be dimensioned greater than the diameter of the separation tube 124 and can accommodate the flow of the fluid $F_4$, e.g., the mixture of the fluid $F_2$ and the fluid $F_3$. Mixing of the fluid $F_3$ from the bypass loop 112 and the fluid $F_2$ from the venturi path 108 in the area of developed fluid flow 126 of the system 100 can reduce the pressure drop between the fluid inlet 104 and the fluid outlet 106, thereby increasing the efficiency of the system 100.

Figure 5:
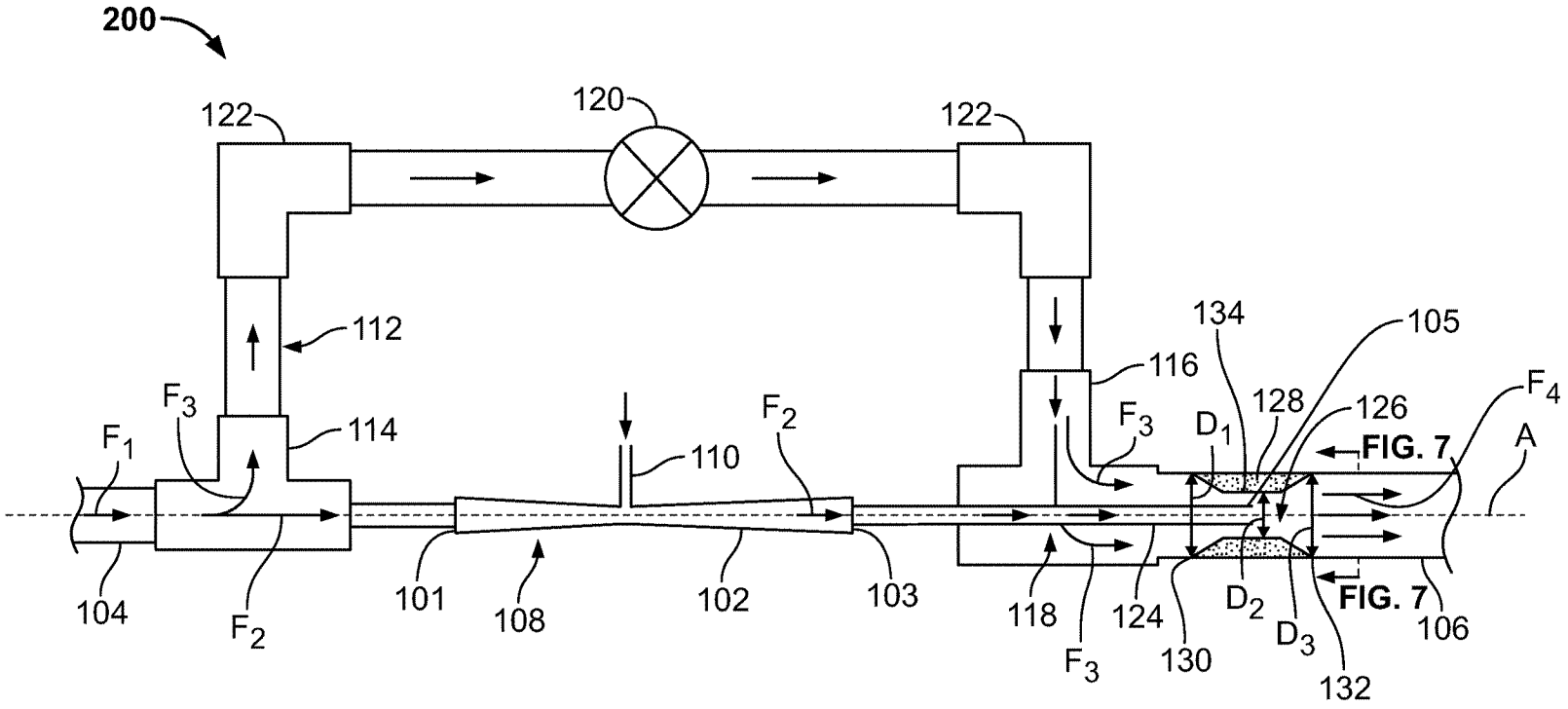
FIG. 5 is a side, partial cross-sectional diagram of a second embodiment of an exemplary venturi bypass system including a first embodiment of an exemplary separation tube and an exemplary velocity ring according to the present disclosure.
Figure 6:
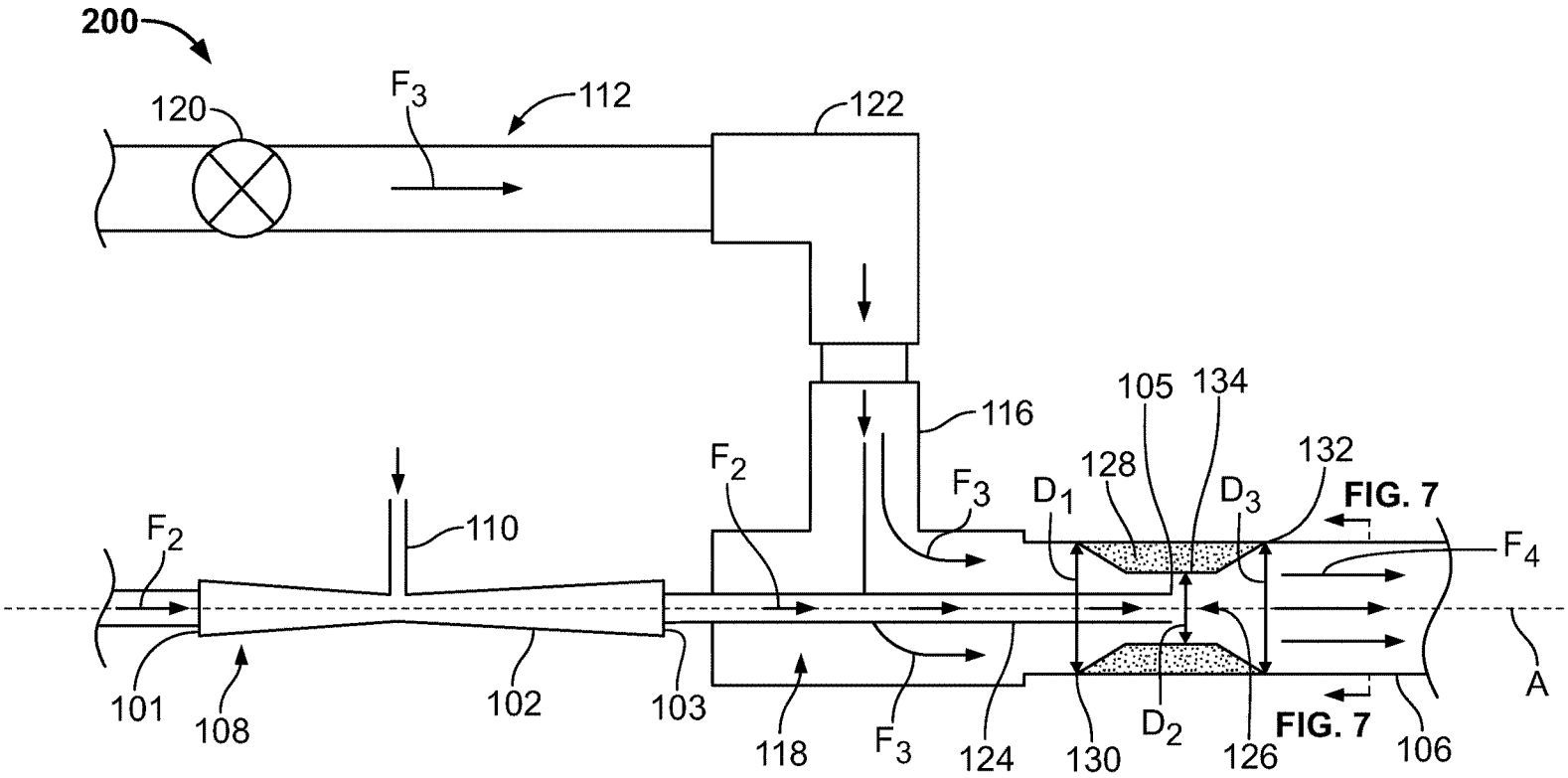
FIG. 6 is a side, partial cross-sectional detailed diagram of a second embodiment of an exemplary venturi bypass system including a first embodiment of an exemplary separation tube and an exemplary velocity ring of FIG. 5.

Turning to FIGS. 5 and 6, side and detailed, partial cross-sectional schematic diagrams of a second embodiment of an exemplary venturi bypass module or system 200 (hereinafter "system 200") are provided. The exemplary system 200 can be structurally and functionally similar to the system 100, except for the features discussed herein. Therefore, like structures are marked with like reference characters. As discussed above, the exemplary system 200 can optionally include a bypass valve 120.

In some embodiments, in addition to the first embodiment of the separation tube 124, the exemplary system 200 can include a velocity ring 128 concentrically positioned between the joint 116 and the fluid outlet 106 in the area of developed fluid flow 126. The velocity ring 128 can be configured and dimensioned to create a restriction within the fluid outlet 106 pipe extending between the joint 116 and the fluid outlet 106. The velocity ring 128 can define an inlet 130 positioned upstream of an outlet 132. In addition, the velocity ring 128 can include a restricted midpoint 134 positioned between the inlet 130 and the outlet 132 of the velocity ring 128. In some embodiments, the inlet 130 of the velocity ring 128 can be dimensioned substantially similar to the diameter $D_1$ of the fluid outlet 106. The section of the velocity ring 128 connecting the inlet 130 to the restricted midpoint 134, e.g., a first tapered section, can taper in a downstream direction at an angle to define a narrower or constricted midpoint diameter $D_2$, e.g., the restricted midpoint 134 diameter. The section of the velocity ring 128 connecting the restricted midpoint 134 to the outlet 132, e.g., a second tapered section, can taper in a downstream direction at an angle to define a wider diameter $D_3$, e.g., a diameter $D_3$ dimensioned substantially similar to the diameter $D_1$ of the fluid outlet 106. Although discussed herein as tapered connecting sections, in some embodiments, the velocity ring 128 can include rounded connecting sections between the inlet 130, the outlet 132 and the restricted midpoint 134.

According to Bernoulli's principle, the restriction of fluid flow created by the restricted midpoint 134 of the velocity ring 128 within the fluid outlet 106 due to the reduction in diameter of the velocity ring 128 can force the fluid flow to increase in velocity and the pressure to decrease as the fluid flows through the velocity ring 128 in a downstream direction. Thus, relative to the high pressure area 118, the velocity ring 128 can create a low pressure area at the midpoint diameter $D_2$. In some embodiments, due to the increased suction in the venturi 102 created by the velocity ring 128, the system 200 can optionally exclude a bypass valve 120.

In some embodiments, the velocity ring 128 can be positioned between the joint 116 and the fluid outlet 106 such that the distal end 105 of the separation tube 124 can be concentrically positioned at a central position along a length of the restricted midpoint 134 of the velocity ring 128. In particular, the separation tube 124 can extend from the venturi outlet 103, through the joint 116 and into the restricted midpoint 134 defined by the diameter $D_2$ of the velocity ring 128. As described above, the fluid $F_2$ discharged from the venturi outlet 103 can flow through the separation tube 124 in a substantially developed manner, thereby bypassing the high pressure area 118 within the joint 116.

In contrast, the fluid $F_3$ discharged from the bypass loop 112 can enter the high pressure area 118 within the joint 116 in a turbulent manner and flow downstream in the direction of the velocity ring 128 without mixing with the fluid $F_2$ from the venturi 102. As the fluid $F_3$ flows downstream of the high pressure area 118, the fluid $F_3$ can progressively stabilize and define at least a partially developed flow before reaching inlet 130 of the velocity ring 128. Upon reaching the inlet 130 of the velocity ring 128, the restriction of fluid $F_3$ flow created by the tapered section leading to the restricted midpoint 134 can increase the velocity of the fluid $F_3$ flow while decreasing the pressure of the fluid $F_3$ flow. As the fluid $F_3$ flows from the inlet 130 and into the restricted midpoint 134, the fluid $F_3$ can progressively stabilize and define a substantially developed flow at the low pressure area. Prior to mixing with the fluid $F_3$, the fluid $F_2$ can continue to flow in a substantially developed manner until reaching the distal end 105 of the separation tube 124 concentrically positioned within the restricted midpoint 134 of the velocity ring 128.

Upon reaching the distal end 105 of the separation tube 124, the fluid $F_2$ can be discharged from the separation tube 124 at the restricted midpoint 134 of the velocity ring 128, e.g., the low pressure point and the area of developed flow 126. The developed flow of the fluid $F_3$ from the bypass loop 112 at the area of developed flow 126 can mix in a substantially developed manner with the fluid $F_2$ mixture of gas, e.g., ozone, and liquid flowing from the separation tube 124. The manner of mixing between the two fluids $F_2$ and $F_3$ can maintain the desired pressure or reduce the amount of pressure drop between the fluid inlet 104 and the fluid outlet 106, thereby increasing the efficiency of the system 200. In some embodiments, the implementation of the venturi separation tube 124 and the velocity ring 128 can act as a secondary venturi which reduces the pressure at the venturi outlet 103 and therefore increases the pressure differential between the venturi inlet 101 and the venturi outlet 103.

Figure 7:
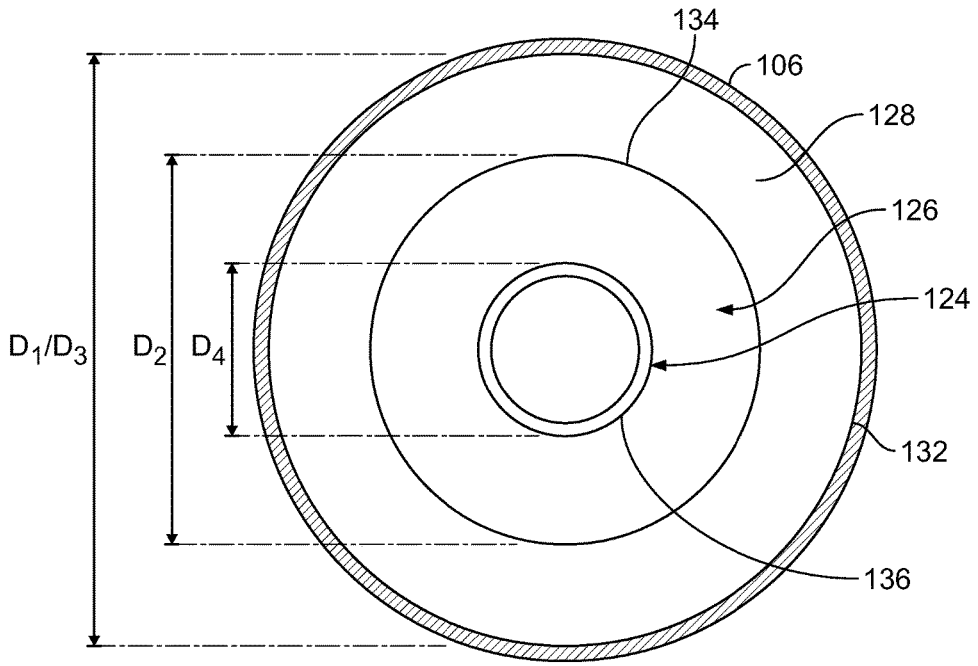
FIG. 7 is a front, cross-sectional detailed diagram of a second embodiment of an exemplary separation tube and an exemplary velocity ring of a second embodiment of an exemplary venturi bypass system of FIG. 5.

With reference to FIG. 7, a front, cross-sectional view of the velocity ring 128 and the separation tube 124 as positioned within the fluid outlet 106 of the system 200 is schematically provided. An area of fluid flow between a diameter $D_4$ of an outer surface 136 of the separation tube 124 and the diameter $D_2$ of the restricted midpoint 134 can define a net area, e.g., a free area. In particular, the net area can be determined based on Equation 1 below:

$$\text{Net Area} = \left(\frac{\pi}{4}\right) \times (D_2^2 - D_4^2) \tag{1}$$

In some embodiments, the net area can affect the efficiency of the system 200, the amount of pressure drop through the system 200, and/or the amount of gas draw through the suction port 110 into the venturi 102. In particular, the smaller the size of the net area, the greater the pressure drop through the system 200 resulting in a greater amount of gas draw by the venturi 102. Similarly, the larger the size of the net area, the smaller the pressure drop through the system 200 resulting in a smaller amount of gas draw by the venturi 102. In addition, a large diameter $D_4$ of the separation tube 124 can result in a low fluid $F_2$ flow rate, while a small diameter $D_4$ of the separation tube 124 can result in a high fluid $F_2$ flow rate.

Different applications can involve different gas draws by the venturi 102. The amount of gas draw by the venturi 102 of the exemplary system 200 can therefore be adjusted by changing the diameter $D_4$ of the outer surface 136 of the separation tube 124 and/or the diameter $D_2$ of the restricted midpoint 134 of the velocity ring 128 to vary the net area. The amount of gas draw or the pressure drop from the venturi 102 can also be adjusted by changing the length of the separation tube 124 such that the distal end of the separation tube 124 can be in an optimal position with respect to the velocity ring 128. For example, the separation tube 124 and/or the velocity ring 128 can be fabricated from low cost materials and in a variety of configurations such that the separation tube 124 and/or the velocity ring 128 can be interchanged in the system 200 to vary the efficiency, pressure drop and/or the amount of gas draw in the system 200.

Although illustrated as including both a separation tube 124 and a velocity ring 128, in some embodiments, the system 200 can include only the separation tube 124. In particular, implementation of the separation tube 124 without the velocity ring 128 can reduce the pressure drop created at the high pressure area 118. As described above, the exemplary system 200 provides a greater efficiency than traditional venturi bypass modules due to the reduced pressure drop between the fluid inlet 104 and the fluid outlet 106 to achieve the desired suction of the venturi 102 and/or by providing an improved suction without increasing the pressure drop.

Figure 8:
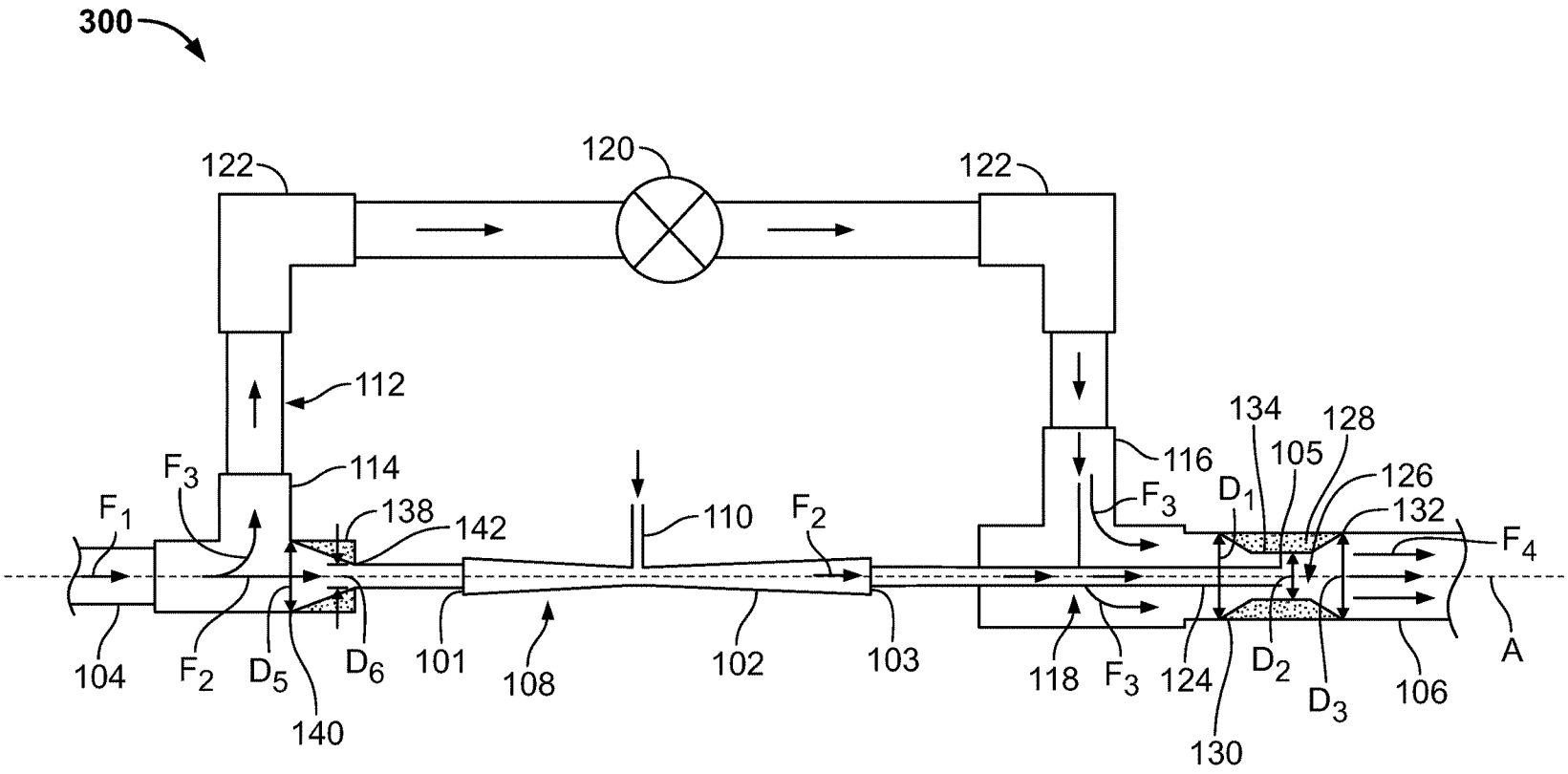
FIG. 8 is a side, partial cross-sectional diagram of a third embodiment of an exemplary venturi bypass system including a first embodiment of an exemplary separation tube, an exemplary velocity ring and an exemplary flow regulator according to the present disclosure.

Turning to FIG. 8, a side, partial cross-sectional schematic diagram of a third embodiment of an exemplary venturi bypass module or system 300 (hereinafter "system 300") is provided. The exemplary system 300 can be structurally and functionally similar to the systems 100 and 200, except for the features discussed herein. Therefore, like structures are marked with like reference characters. As discussed above, the exemplary system 300 can optionally include a bypass valve 120.

In some embodiments, in addition to the first embodiment of the separation tube 124 and the velocity ring 128, the exemplary system 300 can include a flow regulator 138, e.g., a tapered funnel, concentrically positioned within the joint 114. In particular, the flow regulator 138 can be positioned downstream of the separation of the fluid $F_1$ into the fluids $F_2$ and $F_3$ and upstream of the venturi inlet 101. In some embodiments, the flow regulator 138 can regulate the flow of the fluid $F_1$ within the joint 114 and the fluid $F_2$ passing through the venturi path 108. As described above, the fluid $F_1$ can enter through the fluid inlet 104 and separate into the fluid $F_2$ which passes into the venturi path 108 and the fluid $F_3$ which passes into the bypass loop 112 due to the restricted passage of the venturi path 108. In some embodiments, the fluid $F_1$ and/or $F_2$ can carry a certain amount of momentum or kinetic energy as the fluid $F_1$ and/or $F_2$ strikes the venturi inlet 101 and/or the passage leading from the joint 114 to the venturi inlet 101. Thus, the design or configuration of the joint 114, the venturi inlet 101, and/or the passage leading from the joint 114 to the venturi inlet 101 can affect the amount of fluid $F_2$ flow passing through the venturi 102.

The flow regulator 138 can define an inlet 140 positioned upstream of an outlet 142. In some embodiments, the diameter $D_5$ of the inlet 140 can be dimensioned substantially similar to the diameter of the fluid inlet 104. The section of the flow regulator 138 connecting the inlet 140 to the outlet 142 can taper in a downstream direction at an angle to define a narrower or constricted diameter $D_6$. Although discussed herein as a tapered angle, in some embodiments, the flow regulator 138 can define a rounded section connecting the inlet 140 and the outlet 142. The diameter $D_6$ can further define the diameter of the passage leading from the outlet 142 of the flow regulator 138 to the inlet 101 of the venturi 102. Positioning the flow regulator 138 adjacent to the passage leading to the venturi inlet 101 can allow variation of the amount of flow of the fluid $F_2$ into the venturi inlet 101. Depending on the flow characteristics desired for a particular application, the inlet 140 diameter $D_5$, the outlet 142 diameter $D_6$ and/or the taper angle of the flow regulator 138 can be varied to regulate the flow of the fluid $F_2$ into the venturi inlet 101.

Although shown in FIG. 8 as including a velocity ring 128 and a flow regulator 138, it should be understood that the system 300 can include, e.g., only the separation tube 124, the separation tube 124 in combination with the velocity ring 128 without the flow regulator 138, the separation tube 124 in combination with the flow regulator 138 without the velocity ring 128, and the like. In particular, implementation of the separation tube 124 without the velocity ring 128 and without the flow regulator 138 can reduce the pressure drop created at the high pressure area 118. As described above, the exemplary system 100 provides a greater efficiency than traditional venturi bypass modules due to the reduced pressure drop between the fluid inlet 104 and the fluid outlet 106 to achieve the desired suction of the venturi 102 and/or by providing an improved suction without increasing the pressure drop. In addition, the separation tube 124, the velocity ring 128 and/or the flow regulator 138 configurations or designs can be interchangeable to allow variation in the efficiency, pressure drop and/or gas draw of the system 300 depending on the desired application of the system 300.

Figure 9:
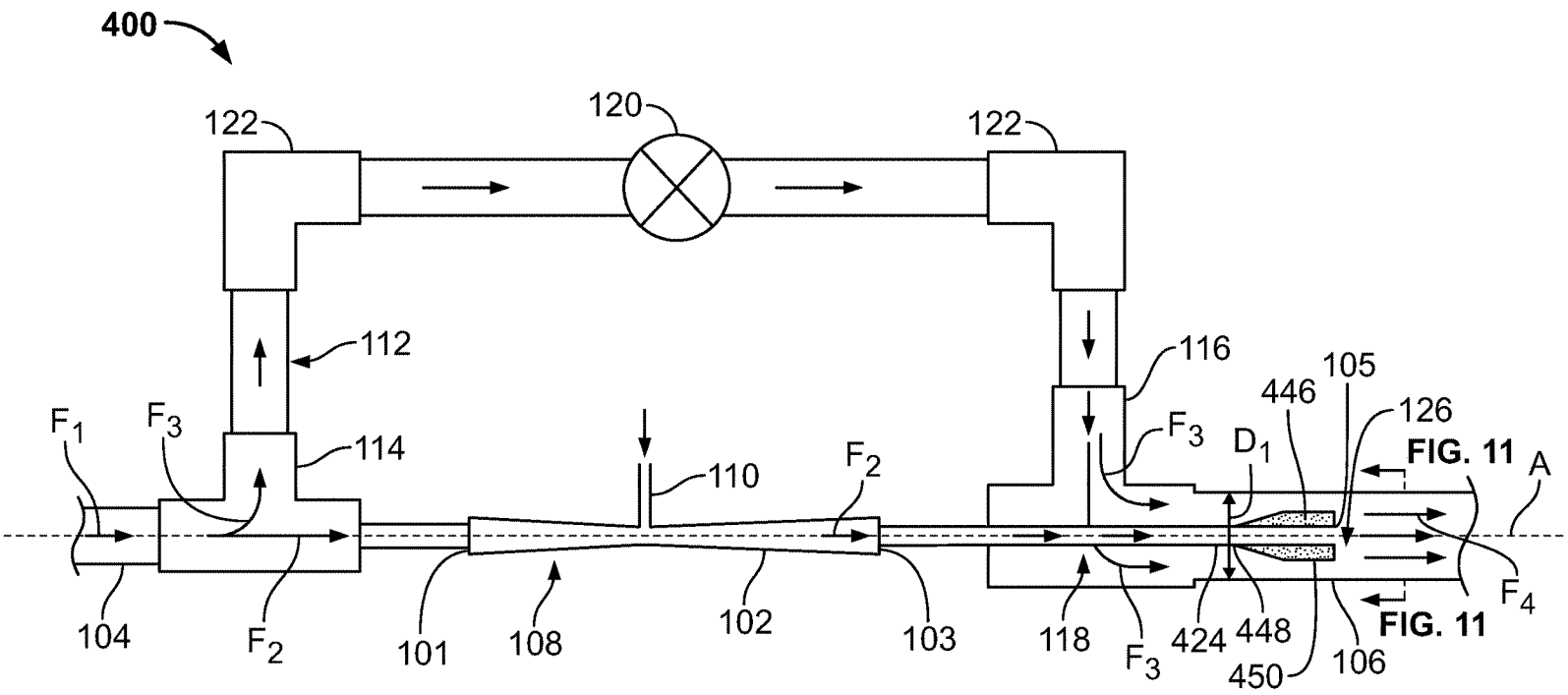
FIG. 9 is a side, partial cross-sectional diagram of a fourth embodiment of an exemplary venturi bypass system including a second embodiment of an exemplary separation tube according to the present disclosure.
Figure 10:
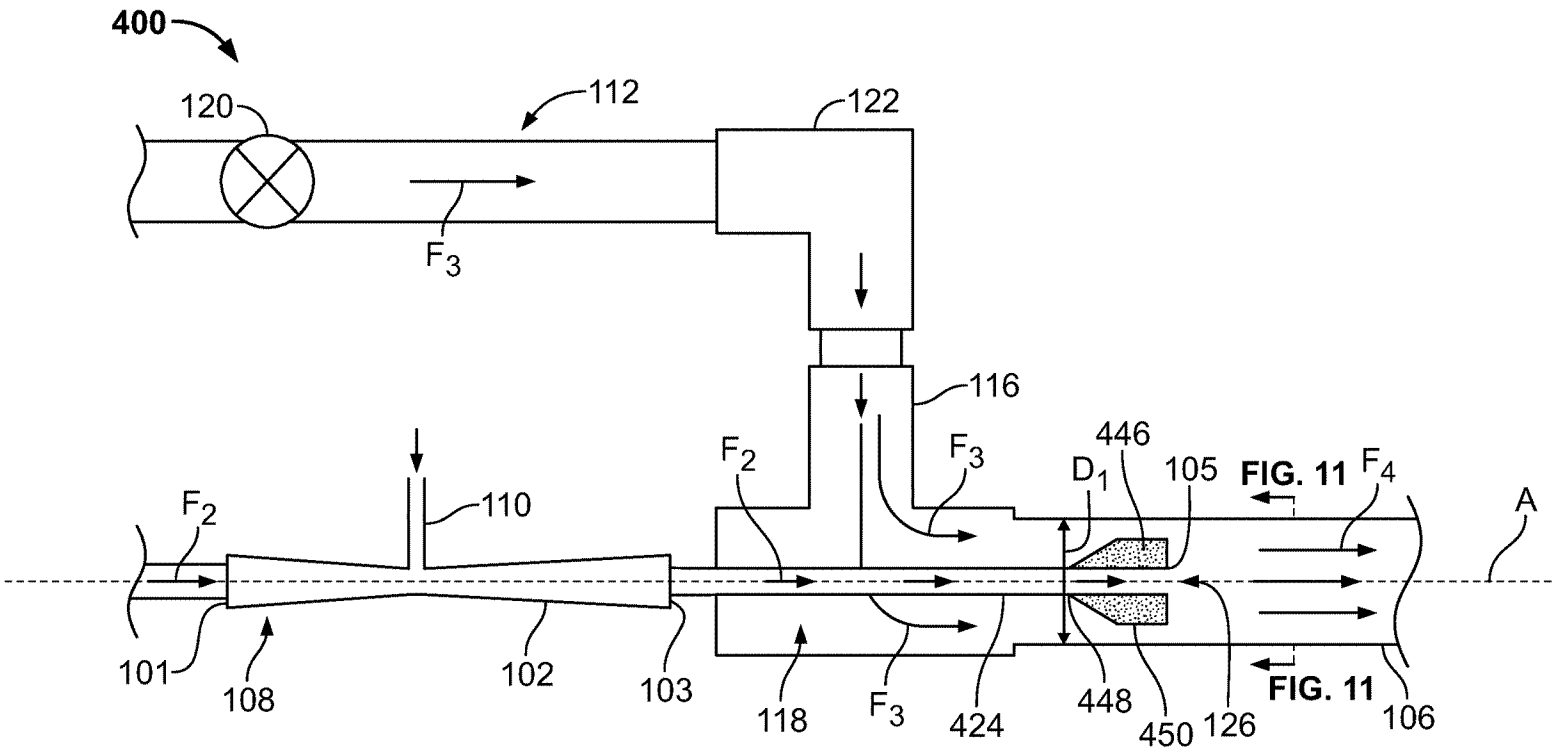
FIG. 10 is a side, partial cross-sectional detailed diagram of a fourth embodiment of an exemplary venturi bypass system including a second embodiment of an exemplary separation tube of FIG. 9.

Turning to FIGS. 9 and 10, a side, partial and detailed cross-sectional schematic diagrams of a fourth embodiment of an exemplary venturi bypass module or system 400 (hereinafter "system 400") are provided. The exemplary system 400 can be structurally and functionally similar to the systems 100, 200 and 300, except for the features discussed herein. Therefore, like structures are marked with like reference characters. As discussed above, the exemplary system 400 can optionally include a bypass valve 120.

In some embodiments, rather than including the first embodiment of the separation tube 124, the system 400 can include a second embodiment of a separation tube 424. Although discussed herein as including the separation tube 424, it should be understood that the system 400 can further include the velocity ring 128 and/or the flow regulator 138 discussed above. The separation tube 424 can extend the flow of fluid $F_2$ exiting the venturi 102 from the venturi outlet 103. In particular, without the separation tube 424, fluid $F_2$ flow exiting the venturi 102 includes a mixture of both liquid and gas, e.g., ozone, which automatically mixes with the fluid $F_3$ flow discharged from the bypass loop 112 in the high pressure area 118 within the joint 116. The mixture of the venturi 102 fluid $F_2$ and the bypass loop 112 fluid $F_3$ in the high pressure area 118 generally reduces the desired pressure differential between the venturi inlet 101 and the venturi outlet 103 across the venturi 102 due to the difference in pressure at the fluid inlet 114 and the high pressure area 118. As discussed above, the venturi 102 efficiency, e.g., the ability of the venturi 102 to create suction on the suction port 110, can generally be proportional to the pressure differential between the venturi inlet 101 and the venturi outlet 103. Thus, to maintain the desired pressure differential through the venturi path 108 for a maximum efficiency of the venturi 102, the reduced pressure differential of traditional bypass modules requires greater pump and/or bypass valve 120 actuation, resulting in excessive and inefficient power consumption.

The venturi separation tube 424 of the system 400 can carry the venturi 102 fluid $F_2$ flow downstream of the high pressure area 118 and into an area of developed fluid flow 126 between the joint 116 and the fluid outlet 106. In particular, the separation tube 424 can separate the flow of the fluid $F_2$ from the fluid $F_3$ until substantially developed fluid flow has been achieved for both fluids $F_2$ and $F_3$. The separation tube 424 can extend from the venturi outlet 103, through the joint 116 and further extend at least partially into the fluid outlet 106. In particular, the separation tube 424 can concentrically extend through the joint 116 and concentrically extend at least partially in the direction of the fluid outlet 106 to the area of developed fluid flow 126. The separation tube 424 can therefore define an inner tube concentrically positioned within an outer tube, e.g., the joint 116 and the tube leading to the fluid outlet 106.

In some embodiments, the separation tube 424 can include a broadening region 446 circumferentially positioned around the outside surface of the distal end 105 of the separation tube 424. In particular, the broadening region 446 can be located around the outer surface of the separation tube 424 and can extend from the distal end 105 of the separation tube 424 upstream in the direction of the joint 116. The broadening region 446 can thereby define a broader outer diameter of the separation tube 424 at or near the distal end 105 while the inner diameter of the separation tube 424 remains constant along the separation tube 424.

The broadening region 446 can include an inlet 448 spaced from the distal end 105 and positioned upstream of a restricted outlet 450. For example, the inlet 448 can be spaced from the distal end 105 and can transition into the restricted outlet 450 which forms a greater outer diameter of the separation tube 424 leading to the distal end 105. In some embodiments, the inlet 448 can be dimensioned substantially similar to the diameter $D_1$ of the fluid outlet 106. The section of the broadening region 446 Connecting the inlet 448 to the restricted outlet 450, e.g., a tapered section, can taper in a downstream direction at an angle to define a narrower or constricted outlet passage within the fluid outlet 106. Although discussed herein as a tapered connecting section, in some embodiments, the broadening region 446 can include a rounded connecting section between the inlet 448 and the restricted outlet 450.

As the inlet 448 transitions to the restricted outlet 450, the cross-sectional area between the inner walls of the fluid outlet 106 and the outer walls of the separation tube 424 can decrease. Similar to the effect created by the velocity ring 128 discussed above, according to Bernoulli's principle, the restriction of fluid flow created by the restricted outlet 450 of the broadening region 446 of the separation tube 424 within the fluid outlet 106 due to the increase in the outer diameter of the separation tube 424 can force the fluid $F_3$ discharged from the bypass loop 112 to increase in velocity and the pressure to decrease as the fluid $F_3$ flows around the separation tube 424 in a downstream direction. Thus, relative to the high pressure area 118, the broadening region 446 of the separation tube 424 can create a low pressure area at the restricted outlet 450. The effect of the velocity ring 128 can thereby be achieved with only the separation tube 424. The low pressure area created by the restricted outlet 450 can extend for a certain distance beyond the distal end 105 of the separation tube 424, thereby promoting mixing between the fluids $F_2$ and $F_3$ in the area of developed fluid flow 126.

In particular, rather than mixing with the fluid $F_3$ discharged from the bypass loop 112 in the turbulent high pressure area 118, the fluid $F_3$ discharged from the bypass loop 112 into the joint 116 can remain separated from the fluid $F_2$ discharged from the venturi outlet 103 by the separation tube 424 until the fluid $F_3$ reaches a distal end 105 or flows beyond the distal end 105 of the separation tube 424 located downstream of the joint 116. In particular, the fluid $F_2$ discharged from the venturi outlet 103 can flow in-line with the venturi 102 and in a substantially developed flow through the length of the separation tube 424 defined by the distance from the venturi outlet 103 to the distal end 105 of the separation tube 424 without mixing with the fluid $F_3$ from the bypass loop 112. The separation tube 424 thereby allows the fluid $F_2$ discharged from the venturi 102 to bypass the high pressure area 118 within the joint 116.

In contrast, the fluid $F_3$ discharged from the bypass loop 112 into the joint 116 can initially flow in a turbulent manner in the high pressure area 118 of the joint 116 without mixing with the fluid $F_2$ from the venturi 102. As the fluid $F_3$ flows downstream of the high pressure area 118 and into the restricted outlet 450 of the broadening region 446 around the separation tube 424, the fluid $F_3$ can progressively increase in velocity and reduce in pressure, thereby stabilizing and defining a substantially developed flow before reaching the distal end 105 of the separation tube 424. Thus, at the distal end 105 and/or beyond the distal end 105 of the separation tube 424 and prior to mixing relative to each other, the flow of both the fluid $F_2$ discharged from the venturi 102 and the fluid $F_3$ discharged from the bypass loop 112 can be substantially developed.

Upon reaching the distal end 105 of the separation tube 424, the fluid $F_2$ can flow out of the separation tube 124 and mix with the fluid $F_3$ in a substantially developed manner in the area of developed fluid flow 126. The fluid outlet 106 diameter $D_1$ can be dimensioned greater than the diameter of the separation tube 424 and can accommodate the flow of the fluid $F_4$, e.g., the mixture of the fluid $F_2$ and the fluid $F_3$. Mixing of the fluid $F_3$ from the bypass loop 112 and the fluid $F_2$ from the venturi path 108 in the area of developed fluid flow 126 of the system 400 can reduce the pressure drop between the fluid inlet 104 and the fluid outlet 106, thereby increasing the efficiency of the system 400.

Figure 11:
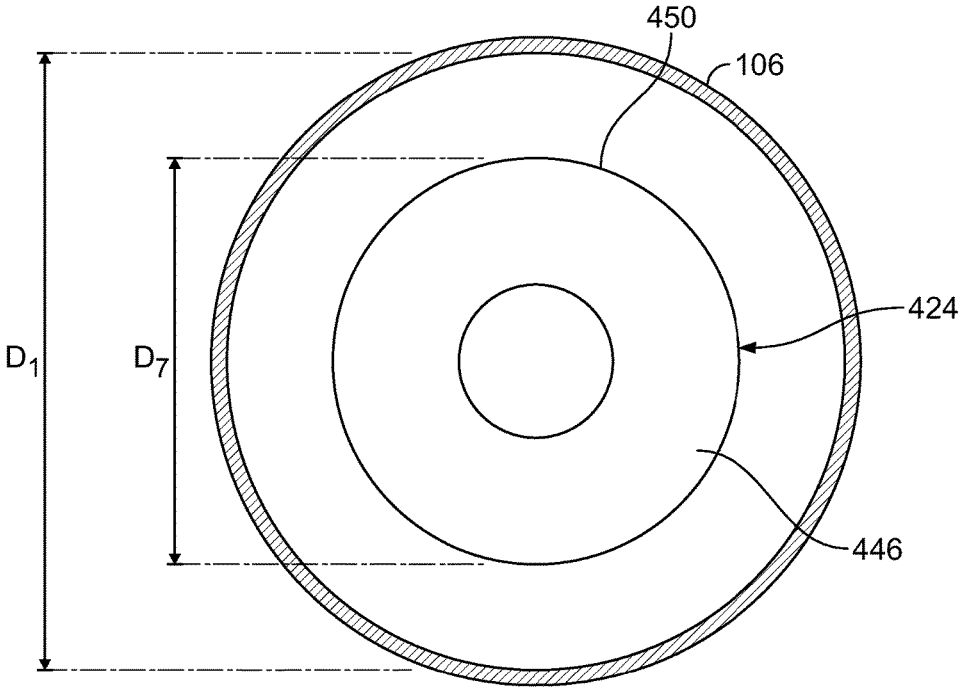
FIG. 11 is a front, cross-sectional detailed diagram of a second embodiment of an exemplary separation tube of a fourth embodiment of an exemplary venturi bypass system of FIG. 9.

With reference to FIG. 11, a front, cross-sectional view of the separation tube 424 as positioned within the fluid outlet 106 of the system 400 is schematically provided. Similar to the discussion related to FIG. 7 above, an area of fluid flow between a diameter $D_7$ of an outer surface of the restricted outlet 450 of the broadened separation tube 424 and the diameter $D_1$ of the inner surface of the fluid outlet 106 can define a net area, e.g., a free area. In particular, the net area can be determined based on Equation 2 below:

$$\text{Net Area} = \left(\frac{\pi}{4}\right) \times (D_1^2 - D_7^2) \tag{2}$$

In some embodiments, the net area can affect the efficiency of the system 400, the amount of pressure drop through the system 400, and/or the amount of gas draw through the suction port 110 into the venturi 102. In particular, the smaller the size of the net area, the greater the pressure drop through the system 400 resulting in a greater amount of gas draw by the venturi 102. Similarly, the larger the size of the net area, the smaller the pressure drop through the system 400 resulting in a smaller amount of gas draw by the venturi 102.

Different applications can involve different gas draws by the venturi 102. The amount of gas draw by the venturi 102 of the exemplary system 400 can therefore be adjusted by changing the diameter $D_7$ of the outer surface of the restricted outlet 450 of the broadened separation tube 424 to vary the net area. Thus, in some embodiments, rather than implementing a velocity ring 128, the net area of the system 400 can be regulated by implementing a separation tube 424 with a broadening region 446. For example, the separation tube 424 can be fabricated from low cost materials and in a variety of configurations such that separation tubes 424 having different diameters $D_7$ of the outer surface of the restricted outlet 450 can be interchanged in the system 400 to vary the efficiency, pressure drop and/or the amount of gas draw in the system 400.

Figure 12:
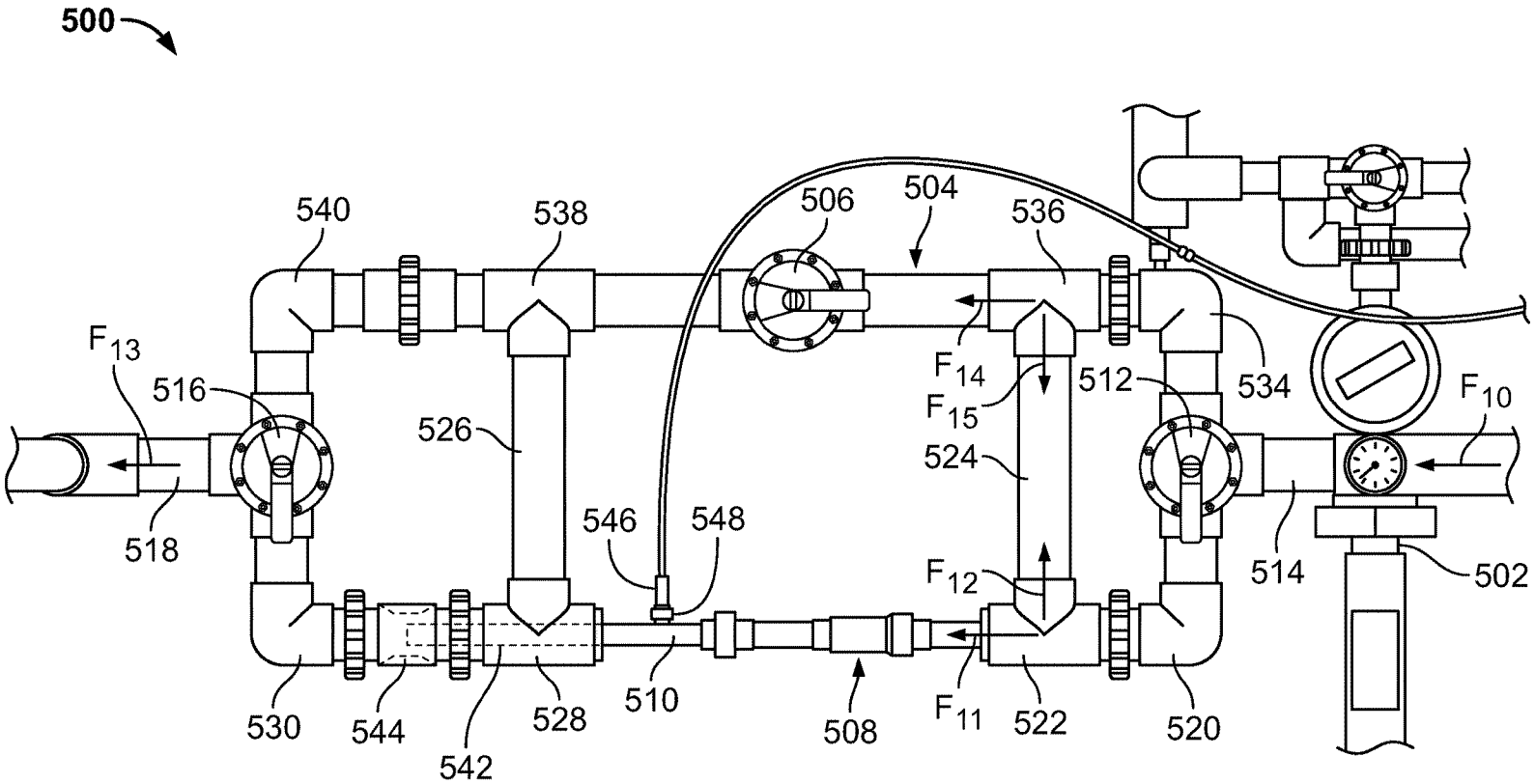
FIG. 12 is a first embodiment of an exemplary test apparatus for a venturi bypass system according to the present disclosure.

Turning to FIG. 12, an exemplary test apparatus 500 is provided which was used for testing and comparing the efficiency of a venturi-preference bypass module 10 and the exemplary system 200. As will be discussed in greater detail below, the components of the test apparatus 500 were reconfigured and actuated to separately test the venturi-preference bypass module 10 and the system 200 under substantially similar operating conditions to determine and compare the efficiency of each configuration.

The test apparatus 500 includes a tank (not shown) which holds water to be pumped through the module and a pump 502 which pumps water through the module. The test apparatus 500 includes a bypass loop 504 including a manual bypass valve 506 and a venturi path 508 including a venturi 510. The test apparatus 500 further includes valve system, i.e., a first three-way valve 512 spaced from a fluid inlet 514 connected to the pump 502 and a second three-way valve 516 spaced from a fluid outlet 518, for regulating the flow of fluid through the test apparatus 500.

As will be discussed in greater detail below, the test apparatus 500 includes a removable separation tube 542 and a removable velocity ring 544. The configuration, dimensions and/or relationship of the separation tube 542 and the velocity ring 544 relative to each other and the other components of the test apparatus 500 were substantially similar to the configuration, dimensions and/or relationship of the separation tube 124 and the velocity ring 128 relative to each other and the components of the systems 100 and 200 discussed above. Although illustrated in FIG. 12 as including the separation tube 542 and the velocity ring 544, it should be understood that for testing the venturi-preference bypass module 10, the separation tube 542 and the velocity ring 544 were removed. For testing the system 200, the separation tube 542 and the velocity ring 544 were included in the test apparatus 500 configuration. It should be understood that the test apparatus 500 could be used to test the system 100 by including the separation tube 542 without the velocity ring 544 in the test apparatus 500 configuration.

The test apparatus 500 includes an ozone draw line 546 connected to a suction port 548 of the venturi 510 for drawing ozone into the fluid $F_{11}$ or $F_{15}$ flowing through the venturi 510. Further, the test apparatus 500 includes pressure gauges (not shown), water flow meters (not shown), and air flow meters (not shown) that indicated the pressure at the fluid inlet 514 and the fluid outlet 518 of the venturi 510, indicated the overall fluid flow through the test apparatus 500, and indicated the suction volume created by the venturi 510, respectively. A plurality of unions and fittings were also implemented to connect the various components of the test apparatus 500 relative to each other.

In particular, the first three-way valve 512 was actuated to direct the flow of fluid $F_{10}$ from the fluid inlet 514 in the direction of the venturi path 508, thereby creating a venturi-preference bypass module 10. For example, fluid $F_{10}$ flowed from the fluid inlet 514, around the elbow 520 and separated at the joint 522, e.g., a T-joint, such that a portion of the fluid $F_{10}$ flowed into the venturi path 508, e.g., the fluid $F_{11}$, and a portion of the fluid $F_{10}$ flowed through the connection 524 into the bypass loop 504, e.g., the fluid $F_{12}$. The second three-way valve 516 was actuated to direct the fluid $F_{12}$ to flow through the bypass valve 506, and through the connection 526 to mix with the fluid $F_{11}$ at the joint 528, e.g., a T-joint. The mixed flow of the fluid $F_{11}$ and the fluid $F_{12}$ further flowed around the elbow 530 and through the fluid outlet 518 as the total fluid $F_{13}$. In addition to the bypass valve 506, the bends or turns in the structure of the test apparatus 500 were configured to create a restriction of the fluid flow through the test apparatus 500.

If desired, for testing the bypass-preference bypass module 50 configuration, the first three-way valve 512 can be actuated to direct the flow of fluid $F_{10}$ from the fluid inlet 514 in the direction of the bypass loop 504. For example, fluid $F_{10}$ can flow from the fluid inlet 514, around the elbow 534 and separate at the joint 536, e.g., a T-joint, such that a portion of the fluid $F_{10}$ flows into the bypass loop 504, e.g., the fluid $F_{14}$, and a portion of the fluid $F_{10}$ flows through the connection 524 into the venturi path 508, e.g., the fluid $F_{15}$. The second three-way valve 516 can be actuated to direct the fluid $F_{15}$ to flow through the venturi path 508, and through the connection 526 to mix with the fluid $F_{14}$ at the joint 538, e.g., a T-joint. The mixed flow of the fluid $F_{14}$ and the fluid $F_{15}$ can further flow around the elbow 540 and through the fluid outlet 518 as the total fluid $F_{13}$. The testing apparatus 500 was configured as described above for the bypass module 10 to determine the efficiency of the bypass module 10.

For experimentation of the exemplary system 200 (and, if desired, the exemplary system 100), the first and second three-way valves 512 and 516 were actuated in positions similar to the venturi-preference bypass module 10. However, in addition to the components used in the test apparatus 500 for the bypass module 10, for testing the system 100, the test apparatus 500 can further include a removable separation tube 542. The separated fluid $F_{11}$ can be passed through the venturi path 508 and through the separation tube 542 prior to mixing with the fluid $F_{12}$. In particular, at the point of mixing, both of the fluids $F_{11}$ and $F_{12}$ can exhibit substantially developed flow. In order to test the system 200, a removable velocity ring 544 was included in the test apparatus 500 such that the separation tube 542 extended to the restricted midpoint of the velocity ring 544, i.e., the middle portion of the velocity ring 544 exhibiting developed fluid flow and a low pressure area. The separated fluid $F_{11}$ was therefore passed through the venturi path 508 and through the separation tube 542 prior to mixing with the fluid $F_{12}$, while the fluid $F_{12}$ was passed approximately halfway through the velocity ring 544 prior to mixing with the fluid $F_{11}$. In particular, at the point of mixing, both of the fluids $F_{11}$ and $F_{12}$ exhibited substantially developed flow. The system 200 was tested with the separation tube 542 and the velocity ring 544 to determine the efficiency of the system 200.

Separation tubes 542 and velocity rings 544 of various dimensions, as well as various valve configurations, were tested in different combinations to determine which configuration exhibited an optimum efficiency for a given flow rate. Separation tubes 542 defining different outer surface diameters and velocity rings 544 defining different diameters at the restricted midpoint were implemented during experimentation to determine net areas (discussed above with respect to FIG. 7) exhibiting the optimum efficiency for a given flow rate. In some experiments, the separation tube 542 was formed from a ½ inch polyvinyl chloride (PVC) nipple and the velocity ring 544 was machined out of a thick-wall piece of PVC pipe. Both the separation tube 542 and the velocity ring 544 were therefore produced from an inexpensive material, while resulting in energy savings during operation of the systems 100 and 200.

Experimentation was performed of the venturi-preference bypass module 10 and the exemplary system 200 utilizing the different configurations or arrangements of the test apparatus 500 discussed above. For testing the venturi-preference bypass module 10, the bypass valve 506 was set to achieve an approximately 14 cubic feet per hour (CFHR) air suction volume on the venturi 510 for testing without the separation tube 542 and the velocity ring 544. For a venturi-preference bypass module 10 arrangement, the results indicated a fluid flow rate of approximately 57 GPM and a pressure drop between the fluid inlet 514 and the fluid outlet 518 of approximately 22 PSI.

For testing the system 200, the separation tube 542 and the velocity ring 544 were added to the testing apparatus 500 and the bypass valve 506 was again set for an approximately 14 CFHR air suction. The results indicated a fluid flow rate of approximately 66 GPM and a pressure drop between the fluid inlet 514 and the fluid outlet 518 of approximately 17 PSI. Thus, the addition of the separation tube 542 and the velocity ring 544 for the system 200 arrangement resulted in a decreased pressure drop by approximately 23% and an overall increase in fluid flow of approximately 16% relative to the results for the venturi-preference bypass module 10. Thus, since the bypass module 10 can typically be considered more efficient than the bypass module 50, the system 200 exhibited a higher efficiency than the bypass modules 10, 50.

Figure 13:
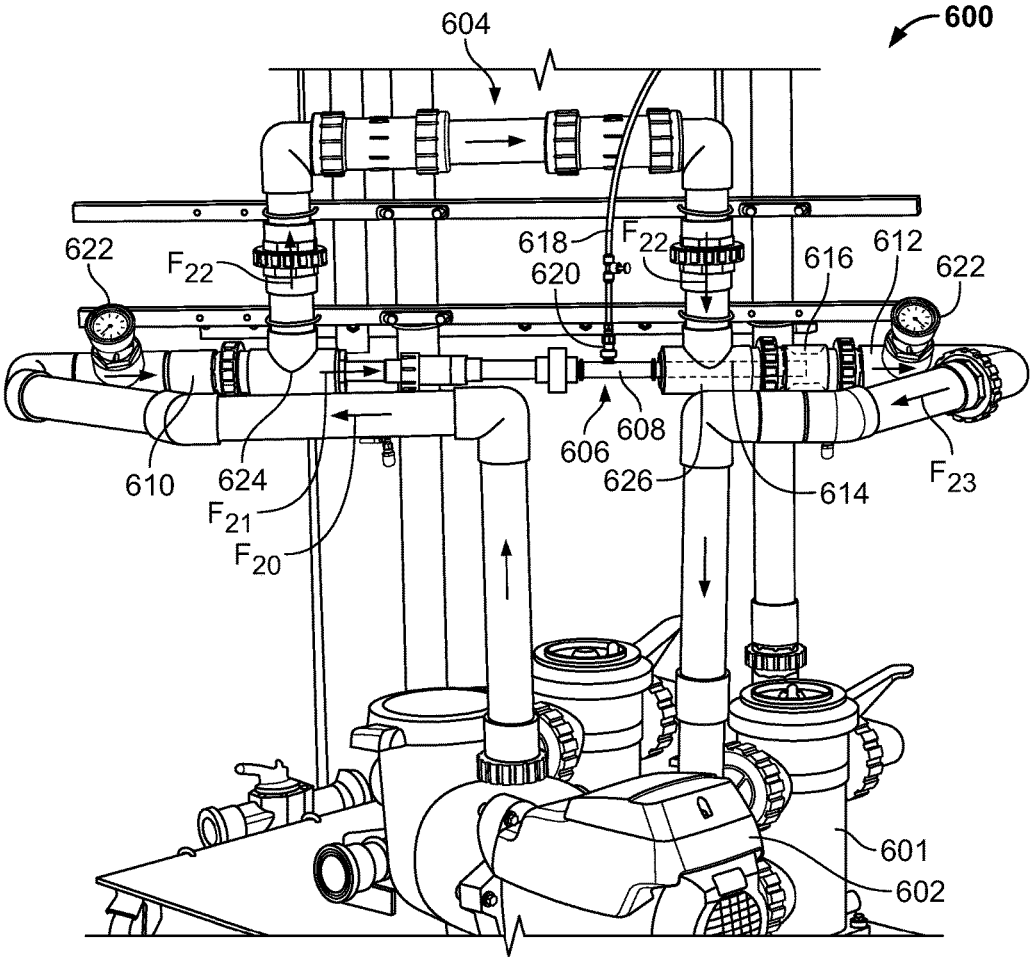
FIG. 13 is a second embodiment of an exemplary test apparatus for a venturi bypass system according to the present disclosure.

Turning to FIG. 13, a second embodiment of an exemplary test apparatus 600 is provided which was used for additional testing and comparing the efficiency of a venturi-preference bypass module 10 and different configurations of the exemplary system 200. As will be discussed in greater detail below, the components of the test apparatus 600 were reconfigured and actuated to separately test the venturi-preference bypass module 10 and the system 200 under substantially similar operating conditions to determine and compare the efficiency of each configuration.

The test apparatus 600 includes a tank 601 which holds water to be pumped through the module and a pump 602 which pumps water through the module. The pump 602 utilized in the test apparatus 600 was a 2 HP 4-speed pump (available from Hayward Industries, Inc.). The test apparatus 600 includes a bypass loop 604 and a venturi path 606 including a venturi 608. The bypass loop 604 was plumbed without a bypass valve to provide the type of regulation of flow a bypass valve would normally provide in the bypass loop 604. The venturi 608 utilized in the test apparatus 600 was a Mazzei Model #684 (available from Mazzei Injector, Inc.). The test apparatus 600 further includes a fluid inlet 610 connected to the pump 602 and a fluid outlet 612.

As will be discussed in greater detail below, the test apparatus 600 includes a removable separation tube 614 and a removable velocity ring 616. The configuration, dimensions and/or relationship of the separation tube 614 and the velocity ring 616 relative to each other and the other components of the test apparatus 600 were substantially similar to the configuration, dimensions and/or relationship of the separation tube 124 and the velocity ring 128 relative to each other and the components of the system 200 discussed above. Although illustrated in FIG. 13 as including the separation tube 614 and the velocity ring 616, it should be understood that for testing the venturi-preference bypass module 10, the separation tube 614 and the velocity ring 616 were removed. For testing the system 200, the separation tube 614 and the velocity ring 616 were included in the test apparatus 600 configuration.

The test apparatus 600 includes an ozone draw line 618 connected to a suction port 620 of the venturi 608 for drawing ozone into the fluid $F_{21}$ flowing through the venturi 608. Further, the test apparatus 600 includes pressure gauges 622, water flow meters (not shown), and air flow meters (not shown) that indicated the pressure at the fluid inlet 610 and the fluid outlet 612 of the venturi 608, indicated the overall fluid flow through the test apparatus 600, and indicated the suction volume created by the venturi 608, respectively. A plurality of unions and fittings were also implemented to connect the various components of the test apparatus 600 relative to each other.

For creating and testing the venturi-preference bypass module 10, the separation tube 614 and the velocity ring 616 were removed from the test apparatus 600. The pump 602 was actuated to direct the flow of fluid $F_{20}$ from the fluid inlet 610 in the direction of the venturi path 606. For example, the fluid $F_{20}$ flowed from the fluid inlet 610 and separated at the joint 624, e.g., a T-joint, such that a portion of the fluid $F_{20}$ flowed into the venturi path 606, e.g., the fluid $F_{21}$, and a portion of the fluid $F_{20}$ flowed into the bypass loop 604, e.g., the fluid $F_{22}$. The fluid $F_{22}$ flowed through the bypass valve 604 and mixed with the fluid $F_{21}$ at the joint 626, e.g., a T-joint. The mixed flow of the fluid $F_{21}$ and the fluid $F_{22}$ further flowed through the fluid outlet 612 as the total fluid $F_{23}$. As discussed above, the bends or turns in the structure of the test apparatus 600 were configured to create a restriction of the fluid flow through the test apparatus 600.

For experimentation of the exemplary system 200, the separation tube 614 and the velocity ring 616 were installed in the test apparatus 600 such that the separation tube 614 extended to the restricted midpoint of the velocity ring 616, e.g., the middle portion of the velocity ring 616 exhibiting developed fluid flow and a low pressure area. It should be understood that if desired, the test apparatus 600 could be used for testing the system 100 by including the separation tube 614 without the velocity ring 616 in the test apparatus 600 configuration. The separated fluid $F_{21}$ was therefore passed through the venturi path 606 and through the separation tube 614 prior to mixing with the fluid $F_{22}$, while the fluid $F_{22}$ was passed approximately halfway through the velocity ring 616 prior to mixing with the fluid $F_{21}$. In particular, at the point of mixing, both of the fluids $F_{21}$ and $F_{22}$ exhibited substantially developed flow.

Velocity rings 616 of various dimensions were tested in different combinations with a separation tube 614 to determine which configuration exhibited an optimum efficiency for a given flow rate. Velocity rings 616 defining different diameters at the restricted midpoint were implemented during experimentation to determine net areas (discussed above with respect to FIG. 7) exhibiting the optimum efficiency for a given flow rate. In some experiments, the separation tube 614 was formed from a ½ inch polyvinyl chloride (PVC) nipple and the velocity rings 616 were machined out of a thick-wall piece of PVC pipe. Both the separation tube 614 and the velocity rings 616 were therefore produced from an inexpensive material, while resulting in energy savings during operation of the system 200 (as will be discussed below).

Experimentation was performed of the venturi-preference bypass module 10 and the exemplary system 200 utilizing the different configurations or arrangements of the test apparatus 600 discussed above. For each experimentation, the pump 602 was tested at each speed (up to the fourth speed) and, in some instances, the airflow or ozone draw in the venturi 608 for the system 200 was measured in near or in excess of approximately 20 SCFHR. This amount of draw is typically greater than the minimum required in applications for the system 200, thus indicating that the system 200 can be modified to further reduce the overall pressure drop and increase the flow rate.

The results for experimentation of the venturi-preference bypass module 10 are provided below in Table 1. The pump speed indicates the speed of the pump 602 during the experiment. The water flow indicates the flow of water through the test apparatus 600 during the experiment. The air flow indicates the amount of draw in the venturi 608 through the ozone draw line 618. In some instances, a bypass valve (not shown) was implemented to create a restriction in the bypass loop 604 to achieve the desired air or ozone draw through the ozone draw line 618. The inlet pressure indicates the pressure at the fluid inlet 610 and the outlet pressure indicates the pressure at the fluid outlet 612. The pressure drop indicates the difference between the pressure at the fluid inlet 610 and the pressure at the fluid outlet 612. The separation tube diameter indicates the outer diameter of the separation tube 614 (e.g., the diameter $D_4$ of the outer surface 136 of the separation tube 124 of FIG. 7). The velocity ring diameter indicates the diameter at the restricted midpoint of the velocity ring 616 (e.g., the diameter $D_2$ of the restricted midpoint 134 of the velocity ring 128 of FIG. 7).

It should be understood that where the separation tube diameter and the velocity ring diameter are indicated as "0", the separation tube 614 and the velocity ring 616 were removed from the test apparatus 600 for testing the venturi-preference bypass module 10. It should also be understood that where a value is followed by a "+" or a "−", the actual value measured was slightly greater than or slightly less than the value listed, respectively. However, for clarity, the values are rounded to whole values.

TABLE 1

Venturi-Preference Bypass Module Results

| Pump Speed | Water Flow (GPM) | Air Flow (SCFHR) | Inlet Pressure (psi) | Outlet Pressure (psi) | Pressure Drop (psi) | Separation Tube Diameter (mm) | Velocity Ring Diameter (mm) |
|---|---|---|---|---|---|---|---|
| 1 | 20 | 0+ | 0 | 0 | 0 | 0 | 0 |
| 2 | 37 | 4 | 6 | 0 | 6 | 0 | 0 |
| 3 | 56 | 9 | 14 | 1 | 13 | 0 | 0 |
| 4 | 72 | 15 | 25 | 5 | 20 | 0 | 0 |

Tables 2-4 below show the results for experimentation of the system 200 with the test apparatus 600. In particular, the separation tube 614 and the velocity ring 616 were included in the configuration of the test apparatus 600 for experimentation of the system 200. Table 2 shows the results for experimentation of the system 200 including a velocity ring 616 with a diameter of approximately 25 mm, Table 3 shows the results for the experimentation of the system 200 including a velocity ring 616 with a diameter of approximately 27 mm, and Table 4 shows the results for the experimentation of the system 200 including a velocity ring 616 with a diameter of approximately 28 mm. As discussed above, the different sizes of the diameter of the velocity ring 616 created different open flow or net areas through the fluid outlet 612.

TABLE 2

System With Separation Tube and Velocity Ring (25 mm) Results

| Pump Speed | Water Flow (GPM) | Air Flow (SCFHR) | Inlet Pressure (psi) | Outlet Pressure (psi) | Pressure Drop (psi) | Separation Tube Diameter (mm) | Velocity Ring Diameter (mm) |
|---|---|---|---|---|---|---|---|
| 1 | 24 | 2− | 0 | 0 | 0 | 16.5 | 25 |
| 2 | 42 | 10 | 5 | 0 | 5 | 16.5 | 25 |
| 3 | 60 | 16 | 12 | 2 | 10 | 16.5 | 25 |
| 4 | 80 | 20+ | 22 | 5 | 17 | 16.5 | 25 |

TABLE 3

System With Separation Tube and Velocity Ring (27 mm) Results

| Pump Speed | Water Flow (GPM) | Air Flow (SCFHR) | Inlet Pressure (psi) | Outlet Pressure (psi) | Pressure Drop (psi) | Separation Tube Diameter (mm) | Velocity Ring Diameter (mm) |
|---|---|---|---|---|---|---|---|
| 1 | 25 | 0+ | 0 | 0 | 0 | 16.5 | 27 |
| 2 | 45 | 5 | 5 | 0 | 5 | 16.5 | 27 |
| 3 | 66 | 13 | 12 | 4 | 8 | 16.5 | 27 |
| 4 | 85 | 19 | 21 | 7+ | 14 | 16.5 | 27 |

TABLE 4

System With Separation Tube and Velocity Ring (28 mm) Results

| Pump Speed | Water Flow (GPM) | Air Flow (SCFHR) | Inlet Pressure (psi) | Outlet Pressure (psi) | Pressure Drop (psi) | Separation Tube Diameter (mm) | Velocity Ring Diameter (mm) |
|---|---|---|---|---|---|---|---|
| 1 | 26 | 0+ | 0 | 0 | 0 | 16.5 | 28 |
| 2 | 46 | 4 | 5 | 0 | 5 | 16.5 | 28 |
| 3 | 67 | 9 | 11 | 4 | 7 | 16.5 | 28 |
| 4 | 86 | 15 | 20 | 8 | 12 | 16.5 | 28 |

As can be seen from the results above, utilization of a separation tube 614 and a velocity ring 616 for the system 200 showed a significant improvement over the results shown in Table 1 for the venturi-preference bypass module 10. For example, as shown in Table 1, at a pump speed of 4, the water flow was approximately 72 GPM and the pressure drop was approximately 20 psi for venturi-preference bypass module 10. In contrast, as shown in Table 4, utilizing a separation tube 614 with a diameter of approximately 16.5 mm and a velocity ring 616 with a diameter of approximately 28 mm for the system 200 increased the was flow to approximately 86 GPM and reduced the pressure drop to approximately 12 psi. The system 200 therefore exhibited a higher efficiency than the venturi-preference bypass module 10. Similarly, since the bypass module 10 can typically be considered more efficient than the bypass module 50, the system 200 exhibited a higher efficiency than the bypass modules 10, 50.

In addition, when utilizing the separation tube 614 and the velocity ring 616, a bypass valve was not needed in the bypass loop 604 due to the developed mixing between the fluid $F_{22}$ discharged from the bypass loop 604 and the fluid $F_{21}$ discharged from the separation tube 614. In some instances, a bypass valve can create friction with the flow of the fluid $F_{22}$ through the bypass loop 604 which can convert to heat and results in waste of the system. Utilization of the separation tube 614 and the velocity ring 616 without a bypass valve can provide cost savings in terms of the components necessary for the system 200 and can further eliminate the potential friction loss caused by the bypass valve, thereby saving the energy to create a low pressure area at the area of developed flow. Thus, in some embodiments, the systems discussed herein can be configured without a bypass valve.

Based on the discussion herein (and the experimentation results with respect to the bypass module 10 and the system 200), by implementing the exemplary systems 100, 200, 300 and/or 400 in the industry, e.g., a swimming pool installation, the desired water turnover rate can be achieved using a smaller pump and/or the on-time of a pool filtration system can be reduced to achieve the required turnover rate. Although discussed herein with respect to a swimming pool application, it should be understood that the exemplary systems 100, 200, 300 and/or 400 can be implemented in a variety of applications requiring a venturi bypass module.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A venturi bypass system, comprising:

a fluid inlet and a fluid outlet, venturi path disposed between, and in-line with, the fluid inlet and the fluid outlet, the venturi path including a venturi defining a venturi inlet and a venturi outlet, a bypass loop connected to the venturi path at a first joint upstream of the venturi outlet and a: second joint downstream of the venturi outlet, and a separation tube connected to the venturi outlet;

a velocity ring disposed between the second joint and the fluid outlet, wherein the separation tube extends fluid flowing through the venturi path downstream of the second joint at which the bypass loop connects to the venturi path.

2. The system according to claim 1, wherein the velocity ring defines a velocity ring inlet, a velocity ring outlet, and a restricted midpoint disposed between the velocity ring inlet and the velocity ring outlet.

3. The system according to claim 2, wherein a restricted midpoint diameter is dimensioned smaller than a velocity ring inlet diameter and a velocity ring outlet diameter.

4. The system according to claim 2, wherein the velocity ring comprises a first tapered section connecting the velocity ring inlet to the restricted midpoint and a second tapered section connecting the restricted midpoint to the velocity ring outlet.

5. The system according to claim 2, wherein a distal end of the separation tube concentrically extends into the restricted midpoint of the velocity ring.

6. The system according to claim 2, wherein the restricted midpoint of the velocity ring defines an area of developed flow and low pressure.

7. The system according to claim 2, wherein fluid discharged from the separation tube mixes with fluid discharged from the bypass loop at the restricted midpoint of the velocity ring to reduce a pressure drop between the fluid inlet and the fluid outlet.

8. The system according to claim 2, wherein an area between an outer surface of the separation tube and an inner surface of the restricted midpoint defines a net area of fluid flow.

9. The system according to claim 8, wherein variation of the net area by variation of at least one of a diameter of the outer surface of the separation tube and a diameter of the inner surface of the restricted midpoint varies an amount of pressure through the venturi bypass system.

10. The system according to claim 8, wherein variation of the net area by variation of at least one of a diameter of the outer surface of the separation tube and a diameter of the inner surface of the restricted midpoint varies an amount of gas draw through a suction port of the venturi.

11. A venturi bypass system, comprising:

a fluid inlet and a fluid outlet, a venturi path disposed between the fluid inlet and the fluid outlet, the venturi path including a venturi defining a venturi inlet and a venturi outlet, a bypass loop connected to the venturi path at a joint upstream of the venturi outlet, and a separation tube connected to the venturi outlet, wherein the separation tube extends fluid flowing through the venturi path downstream of the joint at which the bypass loop connects to the venturi path, wherein the separation tube comprises a broadening region at a distal end of the separation tube, and wherein the broadening region defines a broadening region inlet and a restricted outlet connected by a tapered section.

12. The system according to claim 11, wherein an area between an inner surface of the fluid outlet and the restricted outlet of the broadening region of the separation tube defines a net area of fluid flow.

13. The system according to claim 12, wherein variation of the net area by variation of at least one of a diameter of the restricted outlet and a diameter of the inner surface of the fluid outlet varies an amount of gas draw through a suction port of the venturi.

14. A method of regulating fluid flow of a venturi bypass system, the method comprising:

providing the venturi bypass system, the venturi bypass system including (i) a fluid inlet and a fluid outlet, (ii) a venturi path disposed between, and in-line with, the fluid inlet and the fluid outlet, the venturi path including a venturi defining a venturi inlet and a venturi outlet, (iii) a bypass loop connected to the venturi path at a first joint upstream of the venturi outlet and a second joint downstream of the venturi outlet, and (iv) a separation tube, connecting the separation tube to the venturi outlet, extending the separation tube downstream of the second joint at which the bypass loop connects to the venturi path, and flowing fluid through the separation tube downstream of the second joint at which the bypass loop connects to the venturi path.

15. The method according to claim 14, comprising preventing mixture of fluid flowing through the venturi path with fluid flowing through the bypass loop until a point downstream of the second joint.

16. The method according to claim 14, comprising providing a velocity ring disposed between the second joint and the fluid outlet, the velocity ring defining a velocity ring inlet, a velocity ring outlet, and a restricted midpoint disposed between the velocity ring inlet and the velocity ring outlet.

17. The method according to claim 16, comprising concentrically extending the separation tube into the restricted midpoint of the velocity ring.

18. The method according to claim 16, comprising reducing a pressure drop between the fluid inlet and the fluid outlet by mixing fluid discharged from the separation tube with fluid discharged from the bypass loop at the restricted midpoint of the velocity ring.

19. The method according to claim 14, comprising regulating fluid flow through the venturi path by providing a concentrically disposed flow regulator upstream of the venturi inlet.

20. A method of regulating fluid flow of a venturi bypass system, the method comprising:

providing the venturi bypass system, the venturi bypass system including (i) a fluid inlet and a fluid outlet, (ii) a venturi path disposed between the fluid inlet and the fluid outlet, the venturi path including a venturi defining a venturi irdet and a venturi outlet, (iii) a bypass loop connected to the venturi path at a joint upstream of the venturi outlet, and (iv) a separation tube with a broadening region at a distal end of the separation tube, the broadening region defining a broadening, region inlet and a restricted outlet, connecting the separation tube to the venturi outlet, extending the separation tube downstream of the joint at which the bypass loop connects to the venturi path, and flowing fluid through the separation tube downstream of the joint at which the bypass loop connects to the venturi path.

21. The method according to claim 20, comprising reducing a pressure drop between the fluid inlet and the fluid outlet by passing fluid discharged from the bypass loop around the restricted outlet of the broadening region of the separation tube prior to mixing with the fluid discharged from the separation tube.

* * * * *